US006187495B1

(12) United States Patent
Chiba et al.

(10) Patent No.: US 6,187,495 B1
(45) Date of Patent: Feb. 13, 2001

(54) YELLOW TONER, PROCESS FOR PRODUCING THE TOWER AND IMAGE FORMING METHOD USING THE TONER

(75) Inventors: Tatsuhiko Chiba, Kamakura; Kazuo Yoshinaga, Kawasaki; Satoshi Yasuda, Shizuoka-ken; Hiroaki Kawakami, Yokohama; Ryoichi Fujita, Odawara; Shinya Yachi; Koichi Tomiyama, both of Numazu, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/386,217

(22) Filed: Aug. 31, 1999

(30) Foreign Application Priority Data

Aug. 31, 1998 (JP) ..... 10-244622
Sep. 24, 1998 (JP) ..... 10-269087

(51) Int. Cl.[7] ..... G03G 9/09
(52) U.S. Cl. ..... 430/106; 430/109; 430/137
(58) Field of Search ..... 430/106, 109, 430/137

(56) References Cited

U.S. PATENT DOCUMENTS 5,578,407 11/1996 Kasuya et al. ..... 430/106
5,635,325 6/1997 Inaba et al. ..... 430/106

(List continued on next page.)

FOREIGN PATENT DOCUMENTS 0 705886 4/1996 (EP) .
50-46333 4/1975 (JP) .

(List continued on next page.)

OTHER PUBLICATIONS

Patent Abstract, Japan, vol. 016, No. 100 (P–1323), Mar. 1992.

*Primary Examiner*—John Goodrow
(74) *Attorney, Agent, or Firm*—Fitzpatrick, Cella, Harper & Scinto

(57) ABSTRACT

A yellow toner suitable for electrophotography is formed by dispersing a yellow colorant mixture in a binder resin. The yellow colorant mixture is formed of at least a pigment of formula (1) or (2) below, and a dye of formula (3) below:

(1)

-continued wherein $R_1$ and $R_2$ independently denote a hydrogen atom, a chlorine atom or —$CH_3$, and $R_3$ denotes (2)

wherein $R_1$, $R_2$, $R_3$ and $R_4$ independently denote a hydrogen atom, —COOH, —$COOCH_3$, —$CF_3$, —$CONH(C_6H_4)CONH_2$, or (3)

71 Claims, 6 Drawing Sheets

U.S. PATENT DOCUMENTS

| | | | | |
|---|---|---|---|---|
| 5,707,769 | | 1/1998 | Hagi et al. | 430/106 |
| 5,747,209 | | 5/1998 | Takiguchi et al. | 430/106.6 |
| 5,750,298 | | 5/1998 | Kanabayashi et al. | 430/45 |
| 5,766,816 | | 6/1998 | Nagase et al. | 430/124 |
| 5,863,697 | | 1/1999 | Ochiyama et al. | 430/137 |
| 5,919,592 | * | 7/1999 | Yaguchi et al. | 430/106 |
| 5,998,075 | * | 12/1999 | Fujiwara et al. | 430/106 |
| 6,001,524 | * | 12/1999 | Yoon et al. | 430/109 |
| 6,022,659 | * | 2/2000 | Kanbayashi et al. | 430/106 |
| 6,028,178 | | 2/2000 | Metz et al. | 534/581 |

FOREIGN PATENT DOCUMENTS

| | | |
|---|---|---|
| 51-3244 | 1/1976 | (JP) . |
| 56-116044 | 9/1981 | (JP) . |
| 58-007648 | 1/1983 | (JP) . |
| 58-129437 | 8/1983 | (JP) . |
| 59-026757 | 2/1984 | (JP) . |
| 60-032060 | 2/1985 | (JP) . |
| 60-136752 | 7/1985 | (JP) . |
| 61-117565 | 6/1986 | (JP) . |
| 61-156054 | 7/1986 | (JP) . |
| 61-188546 | 8/1986 | (JP) . |
| 62-295069 | 12/1987 | (JP) . |
| 63-070271 | 3/1988 | (JP) . |
| 63-289559 | 11/1988 | (JP) . |
| 1-059242 | 3/1989 | (JP) . |
| 1-230072 | 9/1989 | (JP) . |
| 2-22296 | 1/1990 | (JP) . |
| 2-210360 | 8/1990 | (JP) . |
| 2-293860 | 12/1990 | (JP) . |
| 3-269068 | 11/1991 | (JP) . |
| 4-243267 | 8/1992 | (JP) . |
| 4-291360 | 10/1992 | (JP) . |
| 5-034978 | 2/1993 | (JP) . |
| 5-046026 | 2/1993 | (JP) . |
| 5-107922 | 4/1993 | (JP) . |
| 5-173417 | 7/1993 | (JP) . |
| 6-011898 | 1/1994 | (JP) . |
| 6-023067 | 2/1994 | (JP) . |
| 6-035320 | 2/1994 | (JP) . |
| 6-266219 | 9/1994 | (JP) . |
| 7-261446 | 10/1995 | (JP) . |
| 7-295360 | 11/1995 | (JP) . |
| 7-306584 | 11/1995 | (JP) . |
| 8-209017 | 8/1996 | (JP) . |

* cited by examiner

YELLOW TONER, PROCESS FOR PRODUCING THE TOWER AND IMAGE FORMING METHOD USING THE TONER

FIELD OF THE INVENTION AND RELATED ART

The present invention relates to a yellow toner for developing electrostatic images in electrophotography or electrostatic printing or forming a toner image by toner jetting. The present invention also relates to a process for producing such a yellow toner and an image forming method using such a yellow toner.

Hitherto, a large number of electrophotographic image forming methods are known. Generally, in such methods, a photosensitive member comprising a photoconductive substrate is uniformly charged and then subjected to imagewise exposure to light to form an electrical latent image (electrostatic image) thereon, and the latent image is then developed with a toner to provide a visible toner image. The toner image is then transferred onto a transfer(-receiving) material, such as paper, as desired, and fixed onto the transfer material, for example, under application of heat, pressure, etc., to obtain a copy or a print.

Many developing methods are known to be incorporated in such an electrophotographic image forming method. Among these, the magnetic brush method and the cascade method using a two-component developer comprising principally a toner and a carrier have been extensively practiced commercially. These methods are both excellent methods capable of relatively stably providing good images but are accompanied with common difficulties arising from the use of a two-component developer, such as accumulation of spent toner on the carrier surface and the change in mixing ratio between the toner and the carrier.

Various proposals of using monocomponent developers consisting of only a toner have also been made including those comprising magnetic toner particles which exhibit excellent performances.

However, a magnetic monocomponent developer has a constraint of containing magnetic powder therein so that it is frequently used in providing black toner but is not used for providing toners used in full-color development in many cases. For this reason, nonmagnetic monocomponent developers are more frequently used in full-color development.

The use of a nonmagnetic monocomponent developer is accompanied with advantages, such as stabler control of developer concentration, simplification of components used in the apparatus and facilitation of accomplishing a compact apparatus body, but is liable to cause instability in charge-imparting performance and toner scattering in the apparatus compared with a conventional two-component developer including carrier particles. In recent years, however, not a few magnetic monocomponent developers capable of providing improved image qualities have been proposed accompanying a remarkable improvement in chargeability, whereby it is becoming possible to effect full-color image formation by using nonmagnetic monocomponent developers, which has been considered difficult heretofore.

In order to exhibit an improved chargeability, a toner has to be easily disintegrated to allow quick charge generation among toner particles. For accomplishing this, Japanese Laid-Open Patent Application (JP-A) 7-306584 has proposed an apparatus including a developing device equipped with means for disintegrating toner agglomerate and means for classifying and selectively supplying toner particles having sizes equal to those before the agglomeration to a developer-carrying member. By removing the toner agglomerate through the disintegration step for allowing selective supply of toner particles, it is actually possible to obviate toner scattering, but in this case, the toner utilization efficiency is lowered compared with the case of using a toner comprising toner particles which have been sufficiently disintegrated in advance. Further, as some portion of the toner particles is agglomerated, the uniform charging of the toner particles is liable to be difficult.

On the other hand, compared with a two-component developer requiring an appropriate rate of toner replenishing so as to keep a constant toner concentration, a toner constituting a nonmagnetic monocomponent developer is required to be instantaneously disintegrated to exhibit a high chargeability at the moment of being used for image formation while exhibiting a high packing rate in the developer container as the toner contained in the container is gradually consumed. JP-A 6-266219 has proposed to use toner particles having a shape factor of 50–85% so as to form a toner layer having a void percentage of 60–75% on the developer-carrying member for development. This is a proposal of defining the toner coating state in the developing region and does not take account of toner packing in a toner container.

JP-A 6-35320 has proposed to use toner stirring means, of which at least one of the shape, location, size and number of drive members of the toner stirring means is changed depending on the species of toner within a toner container. This is a proposal of absorbing the powder resistance of the toner per se within the toner container and does not contemplate the change of powder load resistance of the toner per se.

As means for absorbing powder load resistance of a toner contained in a toner vessel as represented by a developing vessel, a cartridge or a replenishing toner container, JP-A 5-46026 has proposed the detection of torque depending on a remaining toner amount, JP-A 5-107922 has proposed means for controlling toner stirring by detecting a toner powder pressure in proximity to the developing roller, JP-A 5-173417 has proposed to change not only the torque but conditions for stirring depending on a detected quantity, and JP-A 7-295360 has proposed means for load detection at the time of toner supply.

On the other hand, output or recording appliances, such as copying machines or laser beam printers using electrophotographic processes as described above, are required to provide higher quality images faithful to the original by using lots of image data accompanying the progress of digital technique and lower production cost. Particularly, in the case of photographic images, catalogue or technical brochures and maps, it is required to provide extremely fine and faithfully reproduced images without causing collapsion or interruption of even minute image portions.

Corresponding to such a technical trend, a developer subjected to process steps inclusive of developing, transfer and fixation is required to exhibit excellent performances including little toner scattering onto latent images, a high chargeability of the toner per se and a high transferability close to 100% of a developed toner image onto transfer paper.

Conventional methods of providing improved image qualities according to electrophotography have included a method of forming dense ears of a developer on a developer-carrying member and rubbing a latent image on a latent image-bearing member with the ears, and a method of applying a bias electric field between a developer-carrying member and a latent image-bearing member so as to facilitate the jumping of the toner. It has been also adopted to provide an improved toner stirring performance in the developer container, thereby consistently allowing the toner to exhibit a high chargeability. It has been also considered to provide an improved resolution by forming a smaller size of dots constituting a latent image.

Such method for improving the developing performances are very effective and play an important role in obtaining high image qualities, but it becomes necessary to improve the developer per se in order to provide further improved image quality.

Particularly, in the case of full-color image formation wherein monochromatic toners are used for developing and transferred plural cycles at a latent image portion to form multi-layer toner images for providing a full color image, the latent images are liable to lower the potential as they approach the surfacemost images, so that the toner developing performance is liable to change between toners for the uppermost layer and the lowermost layer.

Further, in the full-color image formation, a color mizability under heat-melting is also an important factor, and when a developer having poor color mixability is used, not only it becomes impossible to attain faithful color reproduction but also difficulties such as a lowering in transferability and toner scattering onto non-image potential parts can be caused.

Further, full-color image forming apparatus based on electrophotographic processes, such as digital full-color copying machines or printers, include more complicated organizations than conventional monochromatic copying machines or printers, and accordingly, it has been required that components, particularly relatively large components, such as a photosensitive drum, are reduced in size and simplified in structure for providing a compact apparatus and cost reduction.

Further, a full-color copying machine or a full-color laser beam printer wherein a full-color image is formed by superposition of plural color images, requires a longer time for outputting one image than a monochromatic image forming machine, so that a further higher process speed is required in such a full-color copying machine or laser beam printer.

As the size reduction and increased process speed are required in the copying machine or laser beam printer, the sizes of the electrostatic image-bearing member and the developer-carrying are deceased and the rotation speed thereof are increased. Corresponding thereto, the charge of a developer on the developer-carrying member is liable to be excessively large in a low temperature/low humidity environment, thus being liable to cause so-called "charge-up". Such an excessively charged developer is liable to cause melt-sticking onto the electrostatic image-bearing member when it is disposed on the electrostatic image-bearing member and receives some force from a member abutting thereto.

Accompanying the popularization of printers, etc., in recent years, some users begin to prefer images with low-gloss feel as obtained in a monochromatic copying machine, and tend to desire full-color images with suppressed gloss in harmony with mono-chromatic images from formerly preferred high-gloss images close to photographic images.

A low-gloss print can exhibit a low image density due to reflection light scattering caused by image surface roughness. The image surface roughness largely depends on toner fixability, and the lowering in image density can be improved by improving the fixability. Further, more than the surface gloss of a print, the transmittance becomes an important factor for a transfer material, such as an overhead projector transparency. In this regard, if transmissive light causes internal scattering within the toner layer, the transmittance is lowered, so that the dispersibility of a pigment is believed to largely affect the transmittance.

Regarding the dispersibility of a colorant, JP-A 61-117565 and JP-A 61-156054 have proposed a process wherein a binder resin, a colorant and a charge control agent are dissolved in advance in a solvent, and the solvent is removed to obtain a toner; and JP-A 5-34978 has proposed a process (flushing process) wherein a resin and an aqueous press cake of a pigment are charged in a kneader and kneaded under heating therein to effect dispersion of the pigment in the resin. These processes actually exhibit some effect of improving the pigment dispersion to provide an improved coloring power. However, there have been found some insufficiencies in such processes in order to comply with further demands on the market.

The process of using a solvent (disclosed in JP-A 61-117565 and JP-A 61-156054) involves a difficulty of increased production cost, and the flushing process (disclosed in JP-A 5-34978) wherein the resin and the colorant are required to be sufficiently kneaded under heating and the colorant in the aqueous pressed cake is required to be transferred into the resin, allows the use of only limited resins.

On the other hand, regarding the process for direct toner production through polymerization, JP-A 56-116044 has proposed a process wherein a colorant is used after graft-treatment thereof; JP-A 58-7648 has proposed a process wherein a colorant is used after a treatment with a coupling agent-type dispersant; and JP-A 64-59242 has proposed a process wherein a colorant is used after a treatment with a surfactant-type dispersant.

These processes are actually effective to some extent in providing an improved dispersion of colorant to provide an improved coloring power. However, such processes are yet insufficient in providing toner particles of a minute particle size in an aqueous medium.

For example, the process of using a graft-treated colorant (disclosed in JP-A 56-116044) causes an increased production cost, and the particle forming characteristic of the monomer composition containing the colorant is liable to be insufficient due to the polymerizate of the grafting monomer.

Further, a toner obtained by using a colorant treated with dispersant of a coupling agent-type or a surfactant-type is liable to have inferior chargeability, thus being liable to cause fog.

The dispersion state of a pigment has a great influence on triboelectric chargeability of a toner. JP-A 8-209017 has proposed a toner using a pigment having a cubic shape converted from an acicular shape providing a large surface area. This is effective for improving the transparency, but no effect on electrophotographic performances of the resultant toner has been suggested.

JP-A 6-23067 discloses a toner containing a specific yellow colorant with a possibility of using another yellow colorant up to 75 wt. % of the total yellow colorant in the toner and also a charge control agent not adversely affecting the color hue of the resultant toner. However, the JP reference does not disclose an example of toner containing different colorants, thus failing to disclose an effect of combined use of different colorants.

Further, regarding the use of dyes excellent in dispersibility and transparency, JP-A 50-46333, JP-A 4-291360 and JP-A i-243267 have disclosed dyed particles, and JP-A 62-295069 has disclosed the use of an oil-soluble dye for improving the transparency.

Such dyes can be very easily dispersed in a toner, but the use thereof has been found to involve some problems.

One problem is that a dye has a markedly lower hiding powder than a colorant, so that it is sufficient to form an image on an overhead projector transparency sheet for providing transmitted light image, but an image for providing a reflected light image is liable to be affected by a transfer material on which the image is formed. More specifically, an image formed on paper as a transfer material is 1) liable to exhibit a different color hue affected by the ground color of the paper, and 2) liable to provide a poor halftone image with a vague boundary with the ground color because of a small toner coverage for providing the halftone image. These difficulties are particularly pronounced in the case of a yellow toner having a high lightness.

As has been discussed above, a toner containing a colorant with a sufficient dispersibility and exhibiting satisfactory performances has not been obtained so far.

Particularly, a toner having a smaller particle size is more liable to be affected with respect to its chargeability due to localization of the colorant therein. Accordingly, smaller toners of respective colors require colorants exhibiting a better dispersibility than larger toners so as to have a good balance among hue, spectral reflection characteristic and saturation.

Further, smaller particle size toners promote light scattering to change hue, lightness and density of images, so that a color balance consideration different from that for larger particle size toners tends to be required.

The problems with smaller particle size toners are liable to be pronounced in lower-gloss images as produced in printing with a photomechanically processed plate according to a recent users' preference.

Further, as a problem different from the dispersibility of a colorant, a toner in a fixed toner image is required to be substantially completely melted to an extent that toner particle shapes cannot be discriminated so as not to obstruct color reproduction due to random reflection at the fixed toner image. Further, in a full-color image, an upper toner layer is required to have a transparency so as not to hide a lower toner layer.

The consideration of these factors, various combinations of yellow/magenta/cyan/black toners have been proposed in JP-A 59-26757, JP-A 63-70271, JP-A 1-230072, JP-A 2-293860 and JP-A 6-11898.

However, in order to obtain low-gloss images with little gloss difference from other prints as obtained by using photomechanically processed plates, it is necessary to provide a gloss close to that of paper. For this purpose, incomplete melting of toner particles becomes necessary and the resultant images are noticeably affected by toner-scattered light. Accordingly, conventional combinations of color toners as proposed in the above JP references have become insufficient.

It has been also found that a toner resin designing for preventing complete melting of toner particles results in a toner image on a transparency film causing light scattering due to incomplete melting of the toner particles, thus resulting in a narrower reproducible color region.

It has been also found that incomplete toner melting also results in a hue angle change, thus being liable to fail in objective color reproduction. Particularly, human eyes are sensitive to a hue angle change of yellow, so that the hue angle change is not preferred.

Further, in printer use, it is often required to output black character images in mixture with color images which are liable to have a larger toner coverage than the black images according to a conventional technique. Due to such a difference in toner coverage, the color images are caused to have a higher gloss and are liable to look in relief.

It has been also found that if the toner coloring power is increased in order to compensate for an image density lowering due to light scattering at image surface, fog is liable to be noticeable. This is because a scattered toner image is supplied with a relatively larger heat quantity to exhibit a higher gloss causing an apparently higher image density, thus resulting in noticeable fog.

Further, various developers have been proposed in order to provide improved image qualities also from process viewpoint.

For example, JP-A 51-3244 has proposed a nonmagnetic toner for providing improved image quality by controlling the particle size distribution. The toner consists principally of coarse particles having particle sizes of 8–12 $\mu$m by which it is difficult to develop a latent with a dense toner coverage according to our study. The toner also contains at most 30% by number of particles of at most 5 $\mu$m and at most 5% by number of particles of at least 20 $\mu$m. Accordingly, the particle size distribution is rather broad, thus being liable to lower the uniformity. In order to form a clear image with such a toner consisting of rather coarse particles and having a broad particle size distribution, it is necessary to lay toner particles in a thick layer for each layer in a multi-layer formulation as described above so as to fill gaps between toner particles, thereby providing an apparently increased image density. This leads to a problem of increased toner consumption for a desired image density.

JP-A 58-129437 has proposed a nonmagnetic toner having an average particle size of 6–10 $\mu$m and particles of 5–8 $\mu$m as most frequent particles. However, the particles of at most 5 $\mu$m are as little as at most 15% by number, thus being liable to form images lacking clarity.

According to our study, it has been confirmed that toner particles of at most 5 $\mu$m play a principal role of clearly reproducing minute latent image dots and tightly covering a latent image. particularly, in regard to an electrostatic latent image, an edge portion has a higher electric field intensity than an inner portion due to concentration of electric lines of force, and the clarity of the reproduced toner image is governed by the quality of toner particles gathering at the edge portion. According to our study, the abundance of toner particles of at most 5 $\mu$m is effective for providing an improved highlight gradation.

However, toner particles of at most 5 $\mu$m show a particularly strong attachment force onto the latent image-bearing member surface, thus being liable to cause a difficulty in cleaning of transfer residual toner. If a printing operation is continued while the cleaning of transfer residual toner is insufficient, the sticking of low-resistivity substances, such as paper dust and ozone adduct, and the toner onto the photosensitive member, is liable to occur.

For the purpose of scraping off the low-resistivity substances and toner sticking onto the latent image-bearing member, JP-A 60-32060 and JP-A 60-136752 have proposed the inclusion as an abrasive of inorganic fine powder having a BET specific surface area according to nitrogen adsorption of 0.5–30 $m^2/g$. This is effective for alleviating the toner sticking, but the desired abrasive effect cannot be readily attained unless the charging stability of the developer is not improved, so that a sufficient stabilization of cleaning performance has not been accomplished.

JP-A 61-188546, JP-A 63-289559 and JP-A 7-261446 have proposed the inclusion into a toner of two or three species of inorganic fine particles, for principal purpose of imparting flowability and removing the sticking substance on the photosensitive member as abrasive, and a remarkably increased toner transferability has not been accomplished. Further, as a result of the inclusion of identical chemical species of inorganic fine particles (e.g., silica), in addition to the flowability improvement, the toner chargeability is liable to be unstable, thus being liable to cause toner scattering and fog. Further, the average particle sizes are defined and the particle size distributions are not defined, so that the toner sticking onto the photosensitive member can be caused thereby depending on the particle size distribution.

Further, for the purpose of accomplishing higher image quality, JP-A 2-22296 has proposed the co-use of silica particles and alumina particles. However, as the silica particles have a large BET specific surface area, it is difficult to attain a remarkable spacer effect among toner particles.

On the other hand, as a further application of electrophotography, it has been proposed to transfer and fix a toner image onto a steel material or fabric. In such application, the fixed toner image is required to exhibit further improved heat-resistance and light-fastness in view of frequent outdoor use.

Conventionally used colorants for yellow toners are, generally, azo pigments as represented by C.I. Pigment Yellow 12, 13, 17, etc., mono-azo pigment as represented by C.I. Pigment Yellow 74, 97, 98, etc.; C.I. Pigment Yellow 93, 94, 95 and 180 as pigments with excellent light fastness; and benzimidazole-type azo pigments as disclosed in JP-A 8-262799.

However, these yellow pigments cannot yet be said to be satisfactory pigments for providing yellow toners exhibiting further improved image forming performance and chargeability.

SUMMARY OF THE INVENTION

A generic object of the present invention is to provide a yellow toner capable of solving the above-mentioned problems of the prior art.

A more specific object of the present invention is to provide a yellow toner adaptable to a compact image forming apparatus operated at a high process speed.

Another object of the present invention is to provide a yellow toner with suppressed toner deterioration, surface deterioration of toner-carrying member and toner sticking onto a photosensitive member.

Another object of the present invention is to provide a yellow toner capable of providing a clear color even on a low-gloss image.

Another object of the present invention is to provide a yellow toner capable of providing a transparency image with excellent transmittance.

Another object of the present invention is to provide a yellow toner having excellent weatherability including excellent light-fastness.

Another object of the present invention is to provide a yellow toner with excellent environmental stability.

A further object of the present invention is to provide a process for producing such a yellow toner, and an image forming method using such a yellow toner.

According to the present invention, there is provided a yellow toner, comprising: at least a binder resin and a yellow colorant, wherein the yellow colorant comprises at least a pigment represented by structural formula (1) or structural formula (2) shown below, and a dye represented by structural formula (3) shown below:

[Formula (1)]

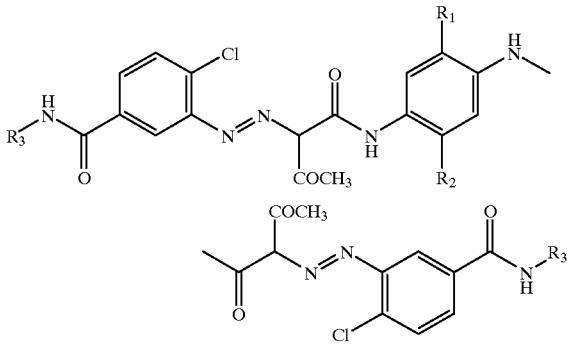

wherein $R_1$ and $R_2$ independently denote a hydrogen atom, a chlorine atom or —$CH_3$, and $R_3$ denotes

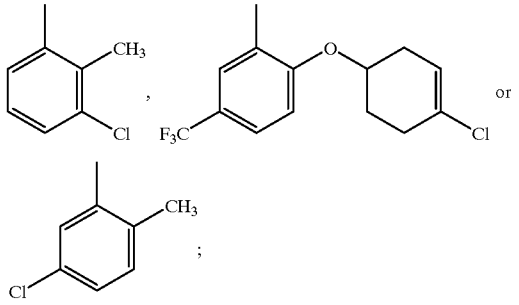

[Formula (2)]

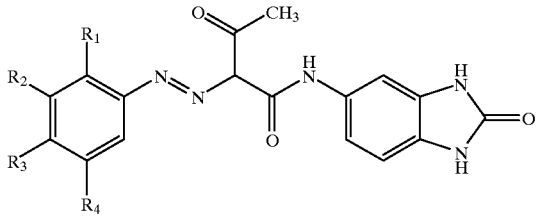

wherein $R_1$, $R_2$, $R_3$ and $R_4$ independently denote a hydrogen atom, —COOH, —$COOCH_3$, —$CF_3$, —$CONH(C_6H_4)CONH_2$, or

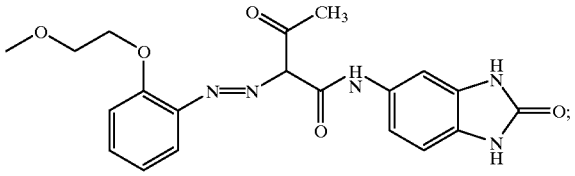

-continued

[Formula (3)]

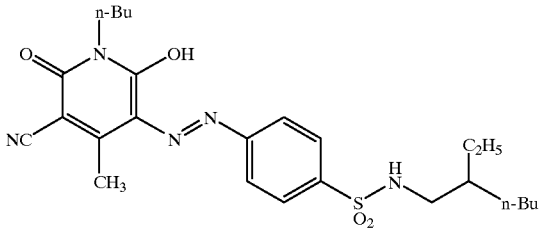

According to another aspect of the present invention, there is provided a process for producing a yellow toner, comprising the steps of:

dispersing a monomer composition comprising at least a polymerizable monomer, a pigment represented by structural formula (1) or structural formula (2) shown above, and a dye represented by structural formula (3) shown above in an aqueous dispersion medium to form particles of the composition, and polymerizing the polymerizable monomer in the dispersed particles to obtain toner particles.

According to a further aspect of the present invention, there is provided an image forming method, comprising: forming an electrostatic image on an image-bearing member, and developing the electrostatic image with a developer carried on a developer-carrying member, wherein the developer comprises the above-mentioned yellow toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
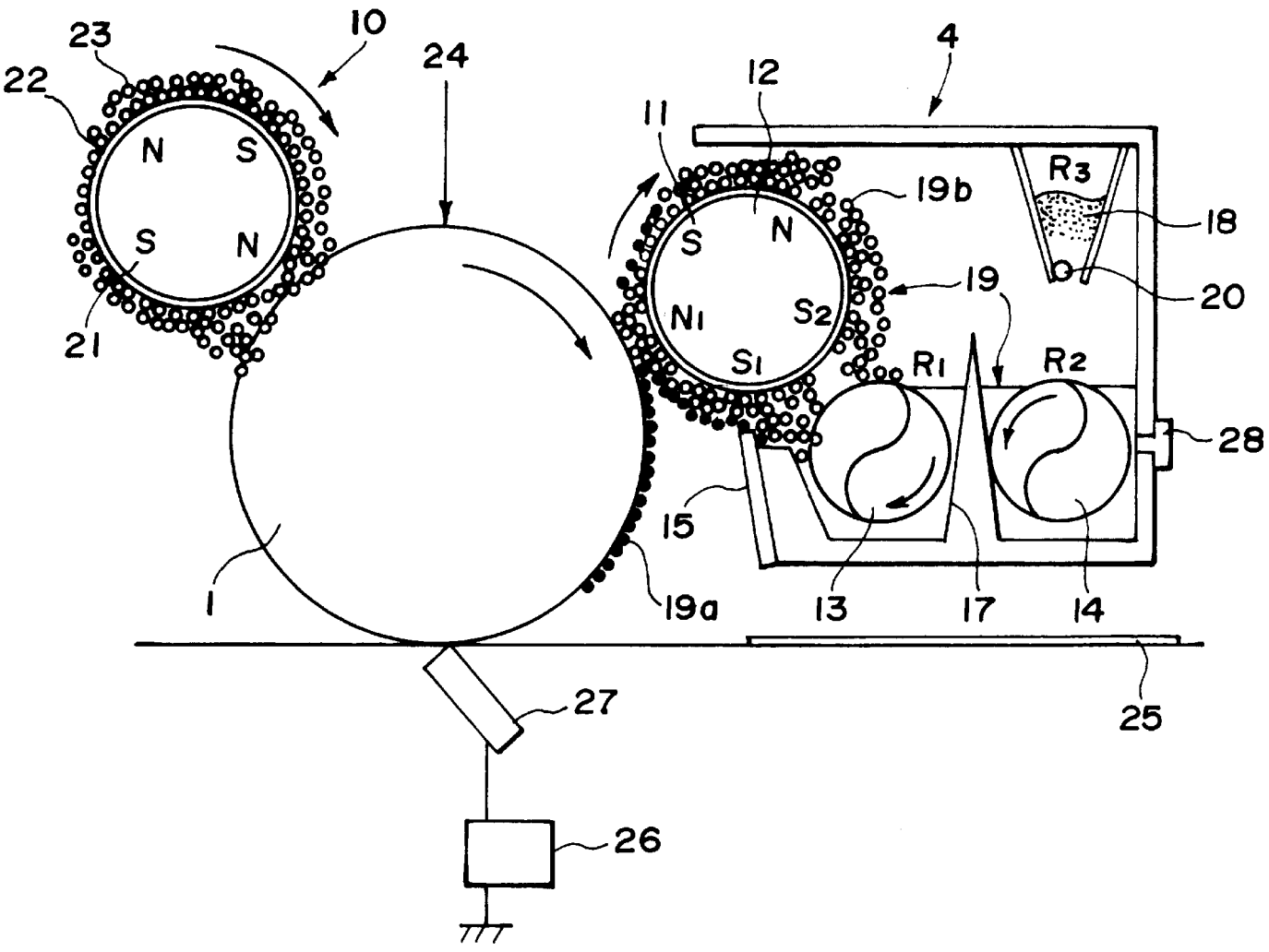
FIG. 1 is a schematic illustration of an image forming system suitable for practicing an embodiment of the image forming method according to the invention.

As a result of our study for accomplishing the above-mentioned objects, it has been found possible to provide a colorant system as a combination of a specific pigment and a specific dye, capable of exhibiting an excellent dispersibility in a toner and capable of providing a yellow toner exhibiting excellent chargeability, developing performances and weatherability, in combination.

The colorant (system) used in the present invention will be first described.

The colorant used in the present invention comprises a pigment of structural formula (1) below (classified under condensed azo pigment) or a pigment of structural formula (2) below (classified under benzimidazolone-based azo pigments), and a dye of structural formula (3) below.

[Formula (1)]

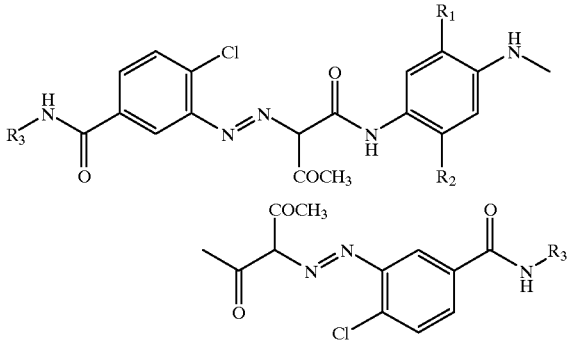

wherein $R_1$ and $R_2$ independently denote a hydrogen atom, a chlorine atom or —$CH_3$, and $R_3$ denotes

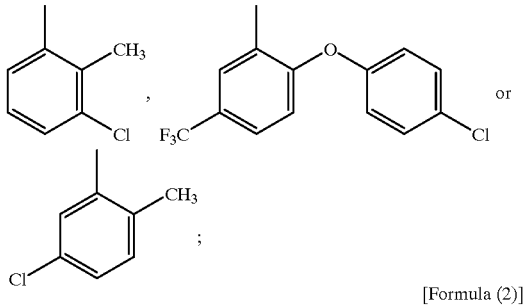

[Formula (2)]

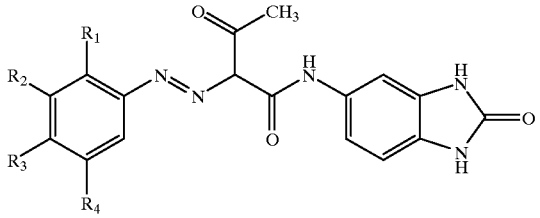

wherein $R_1$, $R_2$, $R_3$ and $R_4$ independently denote a hydrogen atom, —COOH, —$COOCH_3$, —$CF_3$, —$CONH(C_6H_4)CONH_2$, or

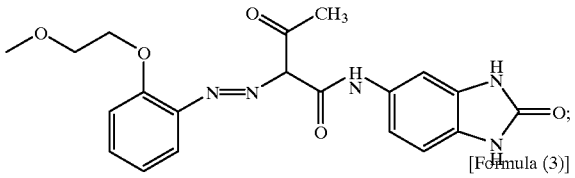

[Formula (3)]

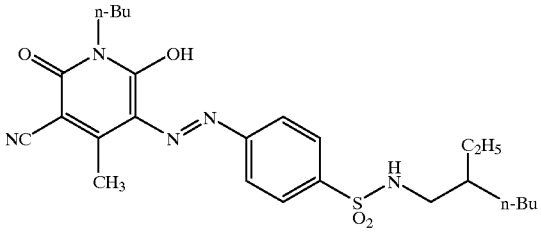

The pigment of structural formula (1) (classified under condensed azo pigments) inclusive of C.I. Pigment Yellow 93 shows excellent light-fastness and heat resistance and has been suitably used in a toner using a binder resin comprising a polar resin as disclosed JP-A 2-210360 and JP-A 3-269068. In case where the pigment is dispersed in a toner, however, the charge of the toner is gradually increased during continuous image formation, particularly in a low temperature/low humidity environment because of a remarkable difference in chargeability between the pigment per se and the binder resin. Moreover, it has been found that the pigment particles are liable to cause electrostatic aggregation, thereby providing a transmission image which exhibits a reddish tint different from that of an image on paper when formed on a transparency film.

The benzimidazolone-based pigment of structural formula (2) is characterized by excellent light-fastness and strong coloring power. When contained alone in a toner, however, the pigment exhibits inferior compatibility with the binder resin and the release agent and is thus liable to cause re-aggregation and lower the toner chargeability.

The oil-soluble dye of structural formula (3) identified as C.I. Solvent Yellow 162 exhibits better compatibility with the binder resin and the release agent than the above-mentioned pigment-type colorants, thus readily providing a toner showing high coloring power and transparency. On the other hand, the dye is liable to cause color change or discoloration by exposure to ultraviolet rays, etc., and is liable to cause difficulties, such as soiling of members such as heating rollers and the carrier, when used alone in a toner.

As a result of out study for solving the above-mentioned problems, it has been found possible to provide a colorant system by combining the pigment of the formula (1) or (2) and the dye of the formula (3) which is liable to exhibit a bluish tint when used alone.

More specifically, it has been found that the aggregation of the condensed azo pigment of the formula (1) or the benzimidazolone-based azo pigment of the formula (2) can be suppressed by co-presence of the dye of the formula (3), so that the pigment can be dispersed at an enhanced level to provide a toner exhibiting more uniform triboelectric chargeability.

In order to attain the effect of the present invention, it is preferred that the pigment of the formula (1) or (2) is contained in 0.5–7.5 wt. parts, more preferably 1.0–6.0 wt. parts, further preferably 2.0–4.0 wt. parts, and the dye of the formula (3) is contained in 0.2–5 wt. parts, more preferably 0.5–4.0 wt. parts, respectively per 100 wt. parts of the binder resin constituting the toner. It is further preferred that the pigment and the dye are contained in a pigment/dye wt. ratio of 0.2–5, more preferably 0.33–3.

If the pigment is contained in excess of 7.5 wt. parts, the toner triboelectric chargeability-stabilizing effect of the dye is liable to be insufficient, the toner is liable to be excessively charged due to a gradual charge increase during continuous image formation, so that the toner is liable to cause melt-sticking onto the electrostatic image-bearing member and fog on the resultant images. Further, in the case of using the pigment of the formula (1) in excess of 7.5 wt. parts, the pigment is liable to cause electrostatic aggregation, thereby providing a transmission image exhibiting a reddish tint different from an image on paper when formed on a transparency film.

If the pigment is contained in less than 0.5 wt. part, it is difficult to obtain a desired coloring power and the resultant toner is liable to form images of lower quality. Further, the toner is liable to have inferior light-fastness.

Further, if the pigment/dye content ratio exceeds 5, the pigment dispersion-improvement effect and the toner chargeability-stabilizing effect attained by the co-use of the dye are reduced, whereby the resultant toner is liable to exhibit a lower charge increase rate. Further, in the case of using the pigment of the formula (1), the transmission image formed on a transparency film is liable to be reddish.

On the other hand, in case where the pigment/dye content ratio is below 0.2, it becomes difficult to attain a desired coloring power thus being liable to result in images with lower image quality. Further, as the influence of the dye becomes noticeable, the carrier and the fixing roller are liable to be soiled, thus resulting in foggy images with the continuation of image formation.

The pigments used in the present invention are not particularly limited as far as they are represented by the formula (1) or (2). In view of hue of the resultant images and easiness of toner production, the following pigments are preferably used.

Thus, preferred examples of the condensed azo pigments of the formula (1) include: C.I. Pigment Yellow 93, 94, 95, 128 and 166. Among these, C.I. Pigment Yellow 93 is particularly preferred.

These preferred examples of the condensed azo pigments are respectively represented by the following structural formulae:

C.I. Pigment Yellow 93

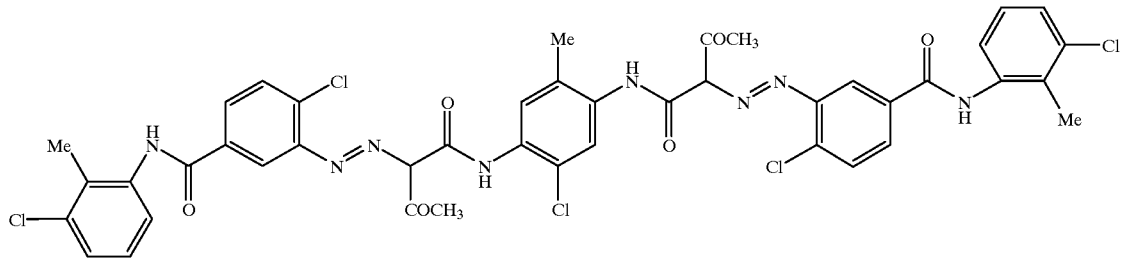

-continued

C.I. Pigment Yellow 94

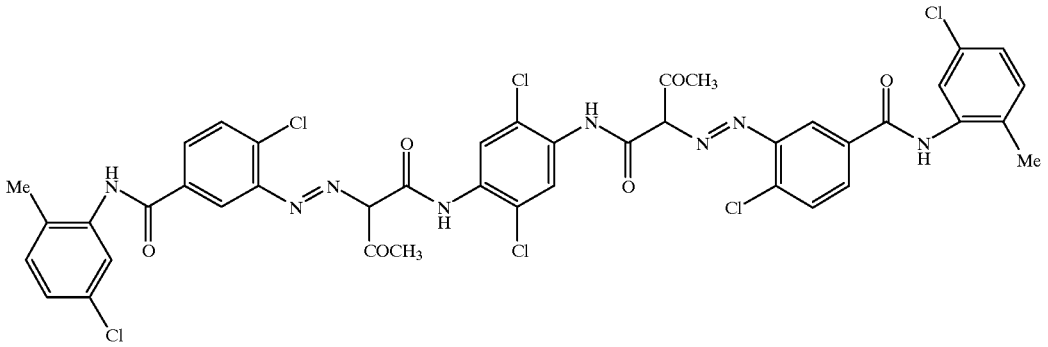

C.I. Pigment Yellow 95

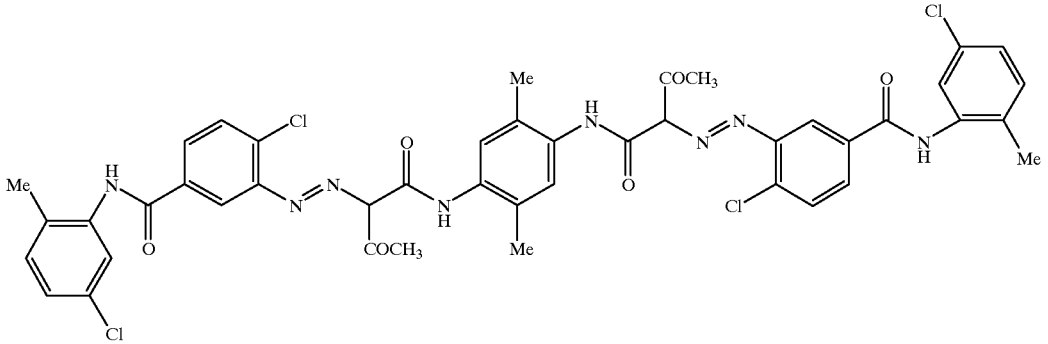

C.I. Pigment Yellow 128

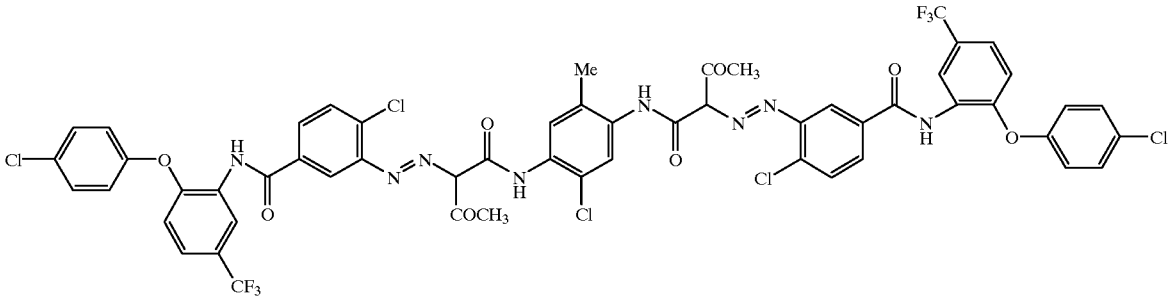

C.I. Pigment Yellow 166

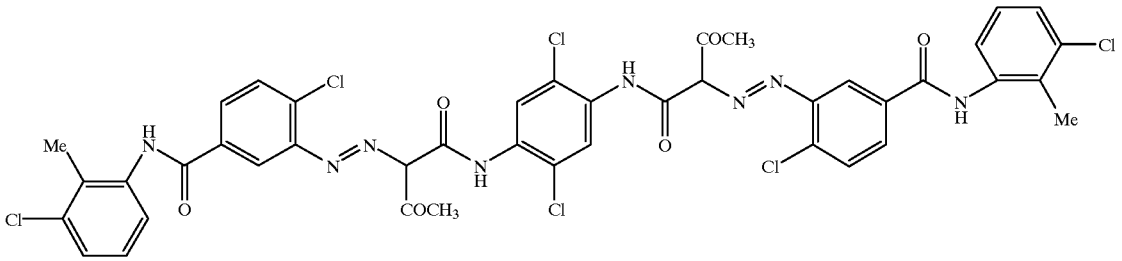

Preferred examples of the benzimidazolone-based azo pigments of the formula (2) may include: C.I. Pigment Yellow 120, 151, 154, 175, 180 and 181. Among these, C.I. Pigment Yellow 180 is particularly preferred.

These preferred examples of the benzimidazolone-based azo pigments are respectively represented by the following formulae:

C.I. Pigment Yellow 120

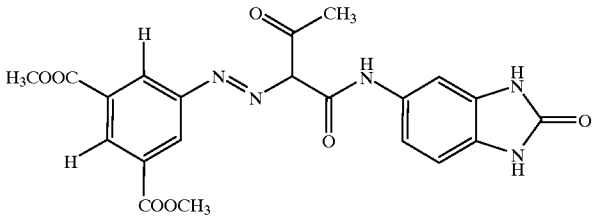

C.I. Pigment Yellow 151

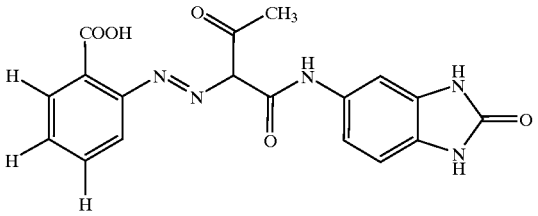

C.I. Pigment Yellow 154

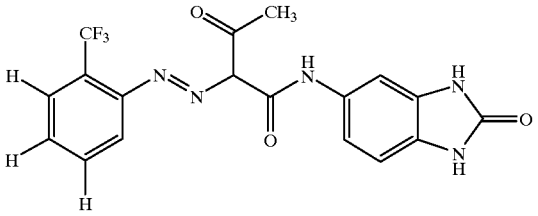

C.I. Pigment Yellow 175

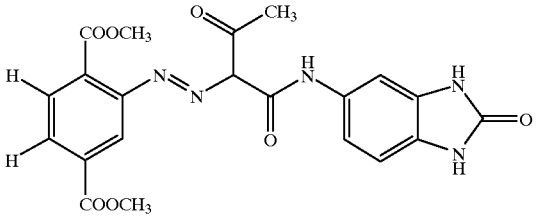

C.I. Pigment Yellow 180

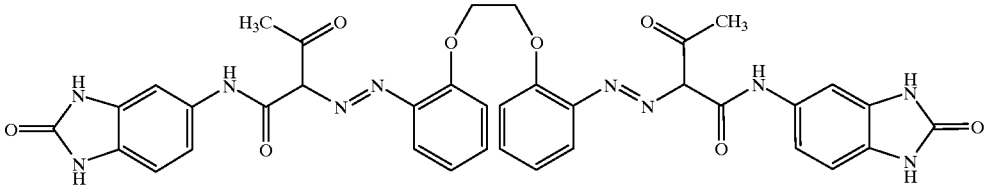

C.I. Pigment Yellow 181

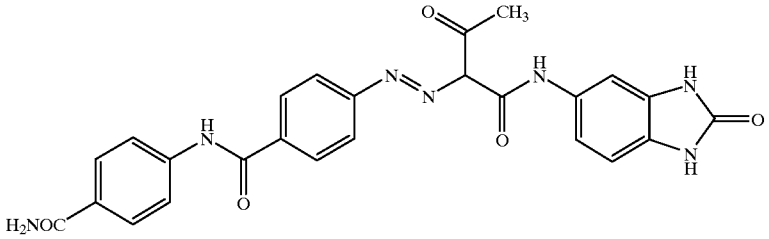

The binder resin constituting the toner of the present invention may suitably comprise a known resin, such as a polyester resin, an epoxy resin, a styrene-acrylic resin, or a combination of these resins. In view of combination with the colorant used in the present invention, particularly in view of moisture-absorptivity of the dye, a low-polarity resin or non-polar resin is preferred, and a binder resin principally comprising a styrene-acrylic resin (i.e., a resin principally comprising a styrene-(meth)acrylate copolymer) is particularly preferred in order to better exhibit the effect of the present invention. Monomers constituting the binder resin, inclusive of styrene-acrylic resin as preferred one, may be known ones, and preferred examples thereof may include: styrene; styrene derivatives, such as (o-, m- or p-) methylstyrene, and (m- or p-) ethylstyrene; (meth)acrylate ester monomers, such as methyl (meth)acrylate, ethyl (meth)

acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth) acrylate, dimethylaminoethyl (meth)acrylate, and diethylaminoethyl (meth)acrylate; and other unsaturated monomers, such as butadiene, isoprene, cyclohexene, (meth)acrylonitrile, and acrylic acid amide. These monomers can be used singly but may preferably be used in combination so as to provide a theoretical glass transition temperature (Tg) (as disclosed in Polymer Handbook, Second Edition III, pp. 139–192 (John Wiley & Sons, Inc.)) of 40–85° C.

If the binder resin (preferably a styrene-acrylic resin) has a theoretical glass transition temperature of below 40° C., the resultant toner is liable to have inferior storage stability and continuous image forming performances. On the other hand, in excess of 85° C., the resultant toner is liable to provide image with particles of residual crystalline portion, whereby the transparency of a full-color OHP image is liable to be remarkably lowered.

The colorants (pigment and dye) used in the present invention respectively have some polar groups, so that the binder resin may preferably be selected to provide a toner with an acid value of 0.02–15 mgKOH/g, more preferably 0.05–12 mgKOH/g, in view of the mutual solubility and prevention of moisture absorption of the toner.

Within an extent of providing a toner having an acid value in the above-mentioned range, the binder resin can further contain a polar resin. If an appropriate proportion of polar resin is contained, the initial dispersion of the colorant during toner production can be promoted and the time required for the dispersion can be shortened. Preferred examples of such a polar resin may include: styrene-(meth) acrylic acid copolymer, maleic acid copolymer, polyester resin and epoxy resin.

The acid value of a toner may be measured in the following manner.

2–10 g of a sample toner is accurately weighted into a 200 to 300 ml-Erlenmeyer flask, and ca. 50 ml of methanol/toluene (=30/70) mixture solvent is added thereto to solve the sample resin. The solution is titrated with a preliminarily standardized 0.1 normal-potassium hydroxide alcohol solution in the presence of a 0.1%-Bromothymol Blue/Phenol Red mixture indicator. From the consumed volume of the KOH-alcohol solution (KOH (ml)), the acid value is calculated by the following equation:

$$\text{Acid value (mgKOH/g)}=[\text{KOH(ml)}\times N\times 56.1]/\text{sample weight},$$

wherein N represents a factor of the 0.1 normal KOH solution.

The binder resin may preferably have a number-average molecular weight (Mn) of $5\times10^3$–$10^6$ and a ratio (Mw/Mn) of 2–100 between the weight-average molecular weight (Mw) and the number-average molecular weight (Mn).

The molecular weight and its distribution described herein are based on values measured by GPC (gel permeation chromatography) according to the following method.

A toner sample is subjected to 20 hours of extraction with toluene by means of a Soxhlet extractor, and then the toluene is evaporated off from the extract liquid. The remaining resinous sample is sufficiently washed with an organic solvent, such as chloroform, which dissolves the release agent but does not dissolve the binder resin. The remaining resin is then dissolved in THF (tetrahydrofuran), and the resultant solution is filtrated through a solvent-resistant membrane filter having a pore diameter of 0.3 $\mu$m to obtain a sample solution, which is then subjected to a GPC measurement by using a GPC apparatus ("Model 150C", available from Waters Co.) equipped with a series of columns (A-801, 802, 803, 804, 805, 806 and 807, all available from Showa Denko K.K.) to obtain a molecular weight distribution based on a calibration curve prepared in advance by using standard polystyrene samples.

The toner according to the present invention can contain ester wax as a release agent so as to accomplish better dispersion of the colorant.

The pigment used in the present invention has a functional group and accordingly exhibits affinity with the ester unit of ester wax, so that the pigment may be taken in the ester wax to be well dispersed in the toner, thus providing a better toner chargeability.

In order to well disperse the pigment, the ester wax may preferably include a long-chain alkyl group having at least 15 carbon atoms, more preferably 15–30 carbon atoms. In case where an ester wax not having such a long-chain alkyl group is contained in the toner, the pigment dispersibility is improved, but the resultant toner is liable to cause offset. An ester wax having a long-chain alkyl group including more than 30 carbon atoms can exhibit an excessively large plasticizing effect, thus being liable to result in a toner having an inferior fixability.

Further, in recent years, image products having full-color images on both surfaces of a transfer sheet are increasingly desired. In producing such image products, a toner image formed on a first surface of transfer paper is again heated at the time of fixation of a toner image on a second (back) surface through a fixing device. Accordingly, a severer consideration is required for providing a toner having better anti-high-temperature offset property. Also from this point, the addition of an ester wax is preferred.

The ester wax may preferably be contained in a proportion of 2–30 wt. % in the toner. More specifically, the ester wax may preferably be contained in 2–15 wt. %, more preferably 2–10 wt. %, in a toner produced through the pulverization process, and in 3–30 wt. %, more preferably 5–20 wt. %, in a toner directly produced through a polymerization process as described hereinafter.

If the ester wax content is below 2 wt. %, it becomes difficult to sufficiently exhibit the pigment dispersion improving effect. In excess of 30 wt. %, the pigment is liable to cause aggregation and be exposed to the surface of or liberated out of the toner particles. Further, if the ester wax is contained in an excessively large proportion, the melt-sticking during toner production and the filming onto the electrostatic image-bearing member are liable to occur.

It is also preferred that the ester wax is contained in a specific proportion with the pigment, i.e., in 60–3000 wt. parts per 100 wt. parts of the pigment so as to enhance the dispersion of and prevent the re-aggregation of the pigment.

In order to enhance the pigment dispersion with the ester wax, it is also possible to prepare a master batch by mixing the ester wax and the pigment in advance.

The ester wax used in the present invention may preferably comprise a compound exhibiting a main peak showing a peaktop temperature of 40–90° C. as measured according to ASTEM D3418-8. If the peaktop temperature is below 40° C., the wax exhibits only a weak self-cohesion to exhibit an inferior anti-high-temperature offset property, thus being undesirable for a full-color toner. On the other hand, if the peaktop temperature is above 90° C., a high fixing temperature is required, so that it becomes difficult to provide a moderately smooth fixed image surface, and the color mixability can be lowered.

The measurement of a main peaktop temperature according to ASTM D3418-8 may be performed by using a differential scanning calorimeter (e.g., "DSC-7", mfd. by Perkin-Elmer Corp.). The detector temperature correction may be performed based on the melting points of indium and zinc, and the calorie correction may be performed based on a heat of fusion of indium. A sample is placed on an aluminum pan and is set in combination with a blank pan for control. The measurement is performed at a temperature-raising rate of 10° C./min.

The ester wax used in the present invention may preferably have a solubility parameter (SP) value in the range of 7.5–10.5. An ester wax having an SP value of below 7.5 is liable to lack in compatibility with the binder resin, thus failing to be well dispersed in the binder resin. On the other hand, if the SP value exceeds 10.5, the resultant toner particles are liable to cause blocking with each other during a long term of storage thereof. Further, because of excessive mutual solubility with the binder resin, it becomes difficult to form a release layer between the fixing member and the binder resin layer, thus being liable to cause offsetting. The SP value may be measured based on additivity of atomic groups according to the Fedors' method [Polymer. Eng. Sci., 14 (2) 147 (1974)].

Examples of the ester wax preferably used in the present invention may include those represented by the following general formulae 1–5.

[Formula 1]

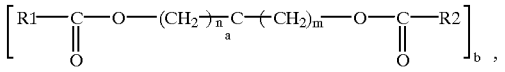

wherein a and b are integers of 0–4 giving a sum of 4; R1 and R2 respectively denote organic groups having 1–40 carbon atoms with the proviso that the difference in number of carbon atoms between R1 and R2 is at least 3; and m and n are respectively integers of 0–25 with the proviso that m and n cannot be simultaneously 0.

[Formula 2]

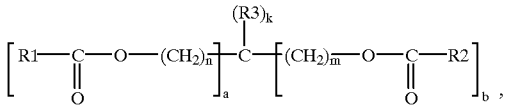

wherein a and b are integers of 0–3 giving a sum of 1–3; R1 and R2 respectively denote organic groups having 1–40 carbon atoms with the proviso that the difference in number of carbon atoms between R1 and R2 is at least 3; R3 denotes a hydrogen atom or an organic group having at least one carbon atom and k is a number satisfying k=4−(a+b); and m and n are respectively integers of 0–25 with the proviso that m and n cannot be simultaneously 0.

[Formula 3]

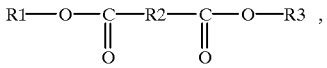

wherein R1 and R3 independently denote an organic group having 6–32 carbon atoms, and R2 denotes an organic group having 1–20 carbon atoms.

[Formula 4]

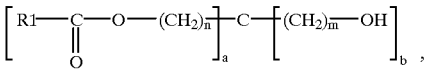

wherein a and b are integers of 1–3 giving a sum of 4; R1 denotes an organic group having 1–40 carbon atoms; and m and n are respectively integers of 0–25 with the proviso that m and n cannot be simultaneously 0.

[Formula 5]

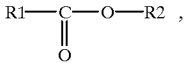

wherein R1 and R2 independently denote an organic group having 15–40 carbon atoms.

The ester wax preferably used in the present invention may have a hardness of 0.5–5.0 in terms of a Vickers hardness measured with respect to a cylindrical sample of 20 mm in diameter and 5 mm in thickness by using a dynamic ultra-micro hardness meter ("DUH-200", available from Shimazu Seisakusho K.K.) based on an indenter trace formed at a loading speed of 9.67 mm/sec under a load of 0.5 g until a displacement of 10 $\mu$m, followed by holding for 15 sec. If the wax has a hardness below 0.5, the resultant toner is liable to exhibit fixing performances remarkably dependent on the fixing pressure and process speed in the fixing device, so that the high-temperature offset prevention effect is liable to be insufficient. On the other hand, if the hardness exceeds 5.0, the resultant toner is also liable to exhibit inferior high-temperature offset prevention effect because of small self-cohesion of the ester wax. Specific examples of the ester wax preferably used in the present invention may include the following compounds:

[Ester wax No. 1]

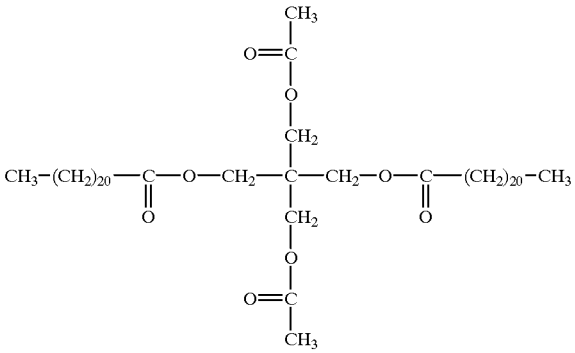

-continued

[Ester wax No. 2]

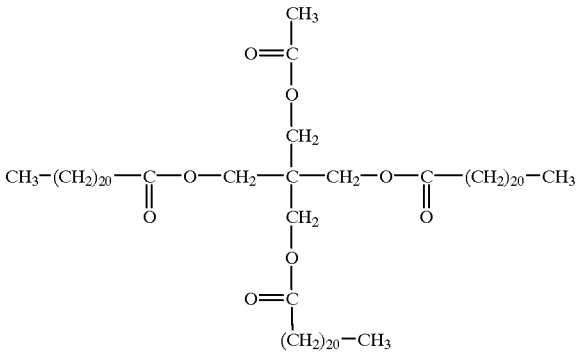

[Ester wax No. 3]

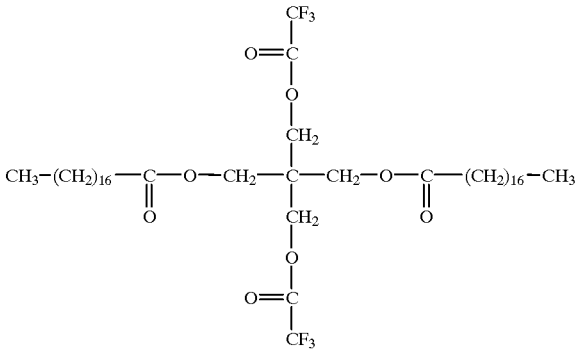

[Ester wax No. 4]

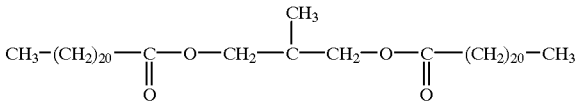

[Ester wax No. 5]

$CH_3(CH_2)_{20}COO(CH_2)_{21}CH_3$

[Ester wax No. 6]

$CH_3(CH_2)_{16}COO(CH_2)_{21}CH_3$

[Ester wax No. 7]

$CH_3(CH_2)_{39}COO(CH_2)_{17}CH_3$

[Ester wax No. 8]

$CH_3(CH_2)_{20}COO(CH_2)_{17}CH_3$

In the present invention, it is also possible to add another wax in addition to the above-mentioned ester wax in order to supplement a release agent effect. Examples of such another wax may include: paraffin wax, polyolefin wax, Fischer-Tropshe wax, amide wax, higher fatty acid, and graft/block-modified products of these.

The toner according to the present invention may preferably further contain an organo-metal compound including a ligand, such as salicylic acid (in a sense of including substitution derivatives thereof similarly as the following acids), naphthoic acid, benzilic acid and dicarboxylic acids. The central metal may comprise aluminum, iron, chromium, zinc, zirconium, silicon or titanium. Such a metal compound functions not only as a charge control agent but also as a colorant dispersion aid to stabilize the toner chargeability. The colorant in the toner according to the present invention includes the dye in addition to the pigment. The metal compound has a function of adsorbing the dye, whereby a problem accompanying the use of a dye such as unstable charge stability may be solved to provide a stable toner chargeability.

It is particularly preferred to use a salicylic acid metal compound so as to realize further better dispersion of the colorant used in the present invention, whereby a desired coloring power can be attained at a smaller amount of the colorant, thereby providing a toner exhibiting a better transparency. An aluminum compound of salicylic acid (in a sense of substitutin derivatives thereof, such as dialkylsalicylic acid) is particularly preferred.

The metal compound may preferably be added in 0.5–10 wt. parts per 100 wt. parts of the binder resin, and more preferably also in 25–300 wt. parts per 100 wt. parts of the dye.

In addition to or instead of the above-mentioned organo-metal compound, it is also possible to use a known charge control agent which is preferably a colorless compound capable of stably providing a constant chargeability. Further, in case where the toner is produced through polymerization as described later, it is preferred to use a charge control agent which is free from polymerization-inhibiting action and contains no water-soluble matter. Specific examples thereof may include: negative charge control agents, such as polymeric compounds having sulfonic acid group or carboxylic acid group in their side chains, boron compounds, urea compounds, silicon compounds, and calixarenes; and positive charge control agents, such as quaternary ammonium salts, polymeric compounds having such quaternary ammonium salt groups at their side chains, guanidine compounds, and imidazol compounds.

The effect of the colorant combination of the present invention is further effectively exhibited when an appropriate toner particle size distribution is selected, more specifically when the toner has such a particle size distribution (as measured with respect to particles of at least 2 $\mu$m) that it exhibits a weight-average particle size (D4) of 3–9 $\mu$m and it includes 4–50% by number of toner particles of at most 4 $\mu$m.

In case where the toner has a weight-average particle size of below 3 $\mu$m or includes more than 50% by number of toner particles of at most 4 $\mu$m, the influence of reflection by toner particles becomes predominant over the improvement in colorant dispersion owing to the colorant combination, thus reducing the effect of the improved colorant dispersion. As a result, the resultant transparency is liable to provide an image which is rather reddish compared with the corresponding image on paper. Moreover, a toner having such a particle size distribution may exhibit an excellent dot reproducibility but is liable to exhibit a lower transferability due to an increased toner image force and cause melt-sticking onto the photosensitive member, etc.

On the other hand, if the toner includes less than 4% by number of toner particles of at most 4 $\mu$m or has a weight-average particle size exceeding 9 $\mu$m, the toner is liable to exhibit inferior image qualities, such as inferior dot reproducibility and highlight gradation reproducibility. Further, as the coloring power is lowered due to the increased toner particle size, the colorant dispersion improvement effect according to the present invention is relatively reduced.

The toner particle size distribution may be measured by using a Coulter Counter TA-II or Coulter Multisizer (available from Coulter Electronics Co.) with an electrolytic solution comprising a ca. 1%-NaCl aqueous solution formed from reagent-grade sodium chloride. A commercially available example thereof is "ISOTON-RII" (available from Counter Electronics Co.).

For measurement, into 100 to 150 ml of such an electrolytic solution, 0.1–5 ml of a surfactant (preferably an alkylbenzenesulfonic acid salt) is added as a dispersant, and further 2–20 mg of a sample toner is dispersed therein. The resultant mixture is subjected to 1–3 min. of dispersion treatment by an ultrasonic disperser and then subjected to a particle size distribution measurement by the above-mentioned measurement apparatus with a 100 μm-aperture to obtain a volume-basis distribution and a number-basis distribution from which a weight-average particle size (D4) is calculated based on a representative frequency for each channel.

The toner according to the present invention can further contain various external additives so as to be provided with further improved properties. Such external additives may preferably have an average particle size which is at most ⅕ of that of the toner particles in view of continuous image forming performance of the resultant toner. The average particle sizes of the additives referred to herein are based on values determined on electron microscopic photographs thereof (e.g., in a state of being mixed with toner particles in the case of external additives). Examples of such additives for improving toner performances may include the following:

1) Flowability improvers, inclusive of: metal oxides, such as silicon oxide, aluminum oxide, and titanium oxide; carbon black; and fluorinated carbon. These may preferably be hydrophobized before use.

2) Abrasives, inclusive of: powders of, metal oxides, such as strontium titanate, cerium oxide, aluminum oxide magnesium oxide, and chromium oxide; nitrides, such as silicon nitride; carbides, such as silicon nitride; carbides, such as silicon carbide; and metal salts, such as calcium sulfate, barium sulfate and calcium carbonate.

3) Lubricants, inclusive of: powders of fluorine-containing resins, such as polyvinylidene fluoride and polytetrafluoroethylene; and fatty acid metal salts, such as zinc stearate and calcium stearate.

4) Charge-controlling particles: inclusive of particles of metal oxides, such as tin oxide, titanium oxide, zinc oxide, silicon oxide and aluminum oxide and carbon black.

These external additives may preferably be added in 0.1–10 wt. parts, more preferably 0.1–5 wt. parts, per 100 wt. parts of toner particles. These additives may be used singly or in combination of plural species.

The toner according to the present invention may suitably be used as a non-magnetic mono-component developer. However, the toner according to the present invention may also be suitably blended with carrier particles to provide a two-component developer. Examples of the carrier may include: surface-oxidized or -non-oxidized particles of magnetic metals, such as iron, nickel, copper, zinc, cobalt, manganese, chromium and rare-earth metals, and magnetic alloys, magnetic oxides and magnetic ferrites of these metals. The production processes of the carrier are not particularly restricted.

The carrier particles may be coated with, e.g., a resin for the purpose of charging performance control, etc. A coated carrier comprising carrier core particles coated with a coating material may be prepared by coating the carrier core with a solution or dispersion of a coating material, such as a resin, or by simple powder blending. The solution coating may be preferred.

The surface-coating materials on the carrier particles may suitably include, for example: amino-acrylate resin, acrylic resin, and copolymers of these resins with styrene resins. As a negatively chargeable resin, it is suitable to use silicone resin, polyester resin, or fluorine-containing resin, such as polytetrafluoroethylene, monochlorotrifluoroethylene polymer, or polyvinylidene fluoride, since they are positioned on a negative side on the chargeability series, but these are not restrictive. The coating amount may appropriately be determined so as to provide satisfactory charging ability to the carrier particles but may generally be in a proportion of 0.1–30 wt. %, preferably 0.3–20 wt. %, of the resultant coated carrier.

A representative example of the carrier (core) particles may include ferrite particles comprising 98 wt. % or more of Cu/Zn/Fe (composition ratios=5–20/5–20/30–80), but the composition thereof is not particularly restricted if a necessary performance is exhibited thereby. It is also possible to use a resinous carrier comprising a binder resin, a metal oxide, and a negative metal oxide, for example.

The carrier particles may preferably have a volume-average particle size of 35–65 μm, more preferably 40–60 μm. It is particularly preferred for the carrier particles to have a particle size distribution such that particles of at most 26 μm occupy 2–6 vol. %, particles of 35–43 μm occupy 5–25 vol. % and particles of at least 74 μm occupy at most 2 wt. %, so as to provide a good image forming performance.

The carrier particles and yellow toner may be blended so as to provide a toner concentration in the resultant developer of generally 2.0–9 wt. %, preferably 3–8 wt. %, for providing generally good results. If the toner concentration is below 2 wt. %, the resultant image density is liable to be low. In excess of 9 wt. %, fog and toner scattering in the apparatus can be frequently caused to shorten the life of the developer.

The toner according to the present invention can be produced through basically any process, inclusive of the pulverization process or the polymerization process, such as suspension polymerization or emulsion polymerization, but a production process not causing the colorant to be present at the toner particle surface is preferred.

From the above viewpoint, the toner according to the present invention may preferably be produced through a so-called suspension polymerization process, i.e., a process including the steps of: dispersing a monomer composition comprising at least a polymerizable monomer, a pigment represented by the structural formula (1) or the structural formula (2), and a dye represented by the structural formula (3) in an aqueous dispersion medium to form particles of the composition; and polymerizing the polymerizable monomer in the dispersed particles to convert the dispersed particles into toner particles.

More specifically, in the suspension process toner production, a polymerizable monomer composition is formed by uniformly dispersing the colorant and optional additives, such as a charge control agent and a release agent, in a polymerizable monomer to form a polymerizable monomer composition; then the polymerizable monomer composition is dispersed in an aqueous medium; and the monomer therein is then polymerized to form toner particles. As a result of the process features, the exposure of the colorant particles to the toner particle surfaces is suppressed. As a result, the thus-obtained toner particles exhibit a stabler chargeability than the toner particles obtained through the pulverization process including a pulverization step for the toner production.

Further, in order to produce toner particles of 9 μm or smaller as measured by a Coulter counter through the pulverization process, it is necessary to realize difficult process controls inclusive of good dispersion of the respective components including the colorant, a high pulverization efficiency and a strict classification for providing a sharper particle size distribution not encountered in production of larger toner particles. However, the polymerization process allows relatively easy production of such small toner particles in a sharp particle size distribution. Further, the polymerization process toner production allows the inclusion of a larger amount of release agent without adverse effects, thereby allowing a broader latitude of material selection.

The monomer for use in the polymerization process toner production may be selected from known monomers, and examples thereof may include those enumerated above for providing the binder resin.

The polymerization of the monomer composition may be proceeded in the presence of a polymerization initiator, examples of which may include: azo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while referring to their 10-hour half-life temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic material, and ferrite. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: commercially available nonionic, anionic and cationic surfactants, such as sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may be produced by the suspension polymerization in the following manner. Into a polymerizable monomer, the colorant, a polymerization initiator and other optional additives, such as a charge control agent and a release agent, are added and uniformly dissolved or dispersed to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a latter stage of the polymerization. It is also possible to subject a part of the aqueous system to distillation in a latter stage of or after the polymerization in order to remove the yet-unpolymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

An embodiment of the image forming method according to the present invention will be described with reference to the drawings.

Referring to FIG. 1, a magnetic brush charger 10 formed of magnetic particles 23 is formed on the surface of a conveyer sleeve 22 and is caused to contact the surface of an electrostatic image-bearing member (photosensitive drum) 1 to charge the photosensitive drum 1. The conveyer sleeve 22 is supplied with a charging bias voltage from a bias voltage application means (not shown). The charged photosensitive drum 1 is illuminated with laser light 24 from an exposure means (not shown) to form a electrostatic image thereon, which is then developed with a toner 19*a* contained in a two-component developer 19 according to the present invention carried on a developing sleeve 11 enclosing a magnet roller 12 therein and supplied with a developing bias AC voltage or DC-superposed AC voltage from a bias voltage source (not shown).

A developing device 4 supplying the developer 19 is divided into a developer chamber $R_1$ and a stirring chamber $R_2$ by a partitioning wall 17, in which developer conveyer screws 13 and 14 are installed respectively. Above the stirring chamber $R_2$ is provided a toner storage chamber $R_3$ containing a replenishing toner 18, and at the bottom of the toner storage chamber $R_3$ is provided a toner replenishing port 20.

In the developing chamber $R_1$, the screw 13 is rotated to stir and convey the developer in the chamber $R_1$ in one direction along the length of the developing sleeve 11. The partitioning wall 17 is provided with openings (not shown) at a near side and a farther side as viewed in the drawing. The developer conveyed to one side of the developer chamber $R_1$ by the screw 31 is fed through the opening at the one side into the stirring chamber $R_2$ and now driven by the developer conveyer screw 14. The screw 14 is rotated in a direction reverse to that of the screw 13 to stir and mix the developer in the stirring chamber $R_2$, the developer conveyed from the developer chamber $R_1$ and a fresh toner replenished from the toner stage chamber $R_3$, and convey the mixture in a direction reverse to that by the screw 13 to supply the mixture into the developer chamber $R_1$ through the other opening of the partitioning wall 17.

For developing an electrostatic image formed on the photosensitive drum 1, the developer 19 in the developer chamber $R_1$ is drawn up by a magnetic force exerted by the magnet roller 12 to be carried on the surface of the developing sleeve 11. The developer carried on the developer sleeve 11 is conveyed to a regulating blade 15 along with the rotation of the developing sleeve 11 to be regulated into a thin developer layer having an appropriate layer thickness and reach a developing region where the developing sleeve 11 and the photosensitive drum 1 are disposed opposite to each other. At a part of the magnet roller 12 corresponding to the developing region is disposed a magnet pole (developing pole) $N_1$. The developing pole $N_1$ forms a developing magnetic field in the developing region, and ears of the developer are formed by the developing magnetic field to provide a magnetic brush of the developer in the developing region. The magnetic brush is caused to contact the photosensitive drum 1, whereby the toner in the magnetic brush and the toner on the developing sleeve 11 are transferred onto a region of electrostatic image on the photosensitive drum 1 to develop the electrostatic image, thereby providing a toner image 19*a* on the photosensitive drum 1.

A portion of the developer having passed the developing region is returned into the developing device 4 wherein the developer is peeled off the developing sleeve 11 by a repulsive magnetic field formed between magnetic poles $S_1$ and $S_2$, to fall into the developer chamber $R_1$ and the stirring chamber $R_2$ to be recovered.

If the developer 19 in the developing device 4 has caused a lowering in T/C ratio (toner/carrier mixing ratio, i.e., a toner concentration in the developer) due to continuation of the above-described operation, a fresh toner 18 in the toner storage chamber $R_3$ is replenished into the stirring chamber $R_2$ at a rate corresponding to the amount consumed during the development, so that the T/C ratio in the developer 19 is kept constant. The T/C ratio of the developer 19 in the device 4 may be detected by using a toner concentration detection sensor 28 equipped with a coil (not shown) therein having an inductance for measuring a chamber in magnetic permeability of the developer to detect the toner concentration.

The regulating blade 15 disposed below the developing sleeve 11 to regulate the layer thickness of the developer 19 on the developing sleeve 11 is a non-magnetic blade formed of a non-magnetic material, such as aluminum or SUS 316. The edge thereof may be disposed with a gap of 300–1000 $\mu$m, preferably 400–900 $\mu$m. If the gap is below 300 $\mu$m, the gap may be plugged with the magnetic carrier to result in an irregularity in the developer layer and a difficulty in applying an amount of toner required for performing good development, thus being liable to result in images with a low density and much irregularity. In order to prevent an irregular coating (so-called "blade-plugging") due to contaminant particles in the developer, the gap may preferably be 400 $\mu$m or larger. Above 1000 $\mu$m, however, the amount of developer applied onto the developing sleeve 11 is increased so that it becomes difficult to effect a prescribed developer layer thickness regulation, whereby the amount of magnetic carrier attachment onto the photosensitive drum 1 is increased and the circulation of the developer and the regulation of the developer by the regulating blade 15 are weakened to provide the toner with a lower triboelectric charge, leading to foggy images.

The magnetic carrier particle layer moves corresponding to the rotation of the developing sleeve in an indicated arrow direction but the speed of the movement becomes slower as the distance from the developing sleeve surface depending on a balance between a constraint force based on magnetic force and gravity and the conveying force in the direction of movement of the developing sleeve. Some developer can even fall due to the gravity.

Accordingly, by appropriately selecting the location of the magnetic poles N and $N_1$, and the flowability and the magnetic properties of the magnetic carrier particles, the magnetic carrier particle layer moves preferentially toward the magnetic pole $N_1$ to form a moving layer. Accompanying the movement of the carrier particles, the developer is conveyed to the developing region following the rotation of the developing sleeve 11.

The thus-developed toner image 19*a* on the photosensitive drum 1 is transferred onto a transfer material (recording material) 25 conveyed to the transfer position by a transfer blade 27, as a transfer means, supplied with a transfer bias electric field supplied from a bias voltage application means 26. Then, the toner image is fixed onto the transfer material 25 by means of a fixing device (not shown). Transfer residual toner remaining on the photosensitive drum 1 without being transferred onto the transfer material in the transfer step is charge-adjusted in the charging step and recovered during the developing step.

The developing sleeve (developer-carrying member) may preferably have an outer diameter of 10–30 mm. Below 10 mm, the developer is liable to be excessively charged, thereby causing noticeable melt-sticking of the developer. On the other hand, if the outer diameter of the developing sleeve exceeds 30 mm, it becomes difficult to reduce the size of the image forming apparatus and also to effect a sufficient developer stirring in the developing device, thus resulting in an image density lowering and image scattering especially in a high temperature/high humidity environment.

In the present invention, it is particularly preferred that the developing sleeve has an outer diameter of 10–30 mm, and in addition the photosensitive drum (electrostatic image-bearing member) has an outer diameter which is 10 to 1 times that of the developing sleeve. If the photosensitive drum has such a large diameter as to provide an outer diameter ratio exceeding 10, the provision of a small image forming apparatus is seriously obstructed, and the transfer of a toner image from the photosensitive drum becomes difficult, thus resulting in images with a lower image density and scattering of line images. On the other hand, if the photosensitive drum has a small diameter as to provide an outer diameter ratio below 1, the photosensitive drum is caused to frequently contact members abutted thereto during image formation, so that the developer melt-sticking onto the photosensitive drum and the soiling of the abutting members become remarkable.

In the present invention, it is further preferred that the photosensitive drum and the developing sleeve have an outer diameter ratio therebetween of 5:1 to 1:1, more preferably 3:1 to 1:1, further preferably 2:1 to 1:1. A photosensitive drum having such an outer diameter ratio with the developing sleeve is caused to frequently contact the abutting members, so that the developer melt-sticking or soiling of the abutting members is liable to occur as described above. However, as the yellow toner of the present invention contains the colorant in a well dispersed state to have an excellent chargeability characteristic, the toner can effect good image formation without causing developer melt-sticking or soiling of the abutting members even under such severe conditions.

In the image forming method according to the present invention, it is preferred to use members abutted to the photosensitive drum, such as a cleaning member and a contact charging member, particularly at least two members abutted to the photosensitive drum. In such an image forming system, the stable chargeability and little soiling characteristic for such contacting members of the yellow toner according to the present invention are most effectively exhibited to allow good image formation over a long period even under such severe conditions.

Figure 3:
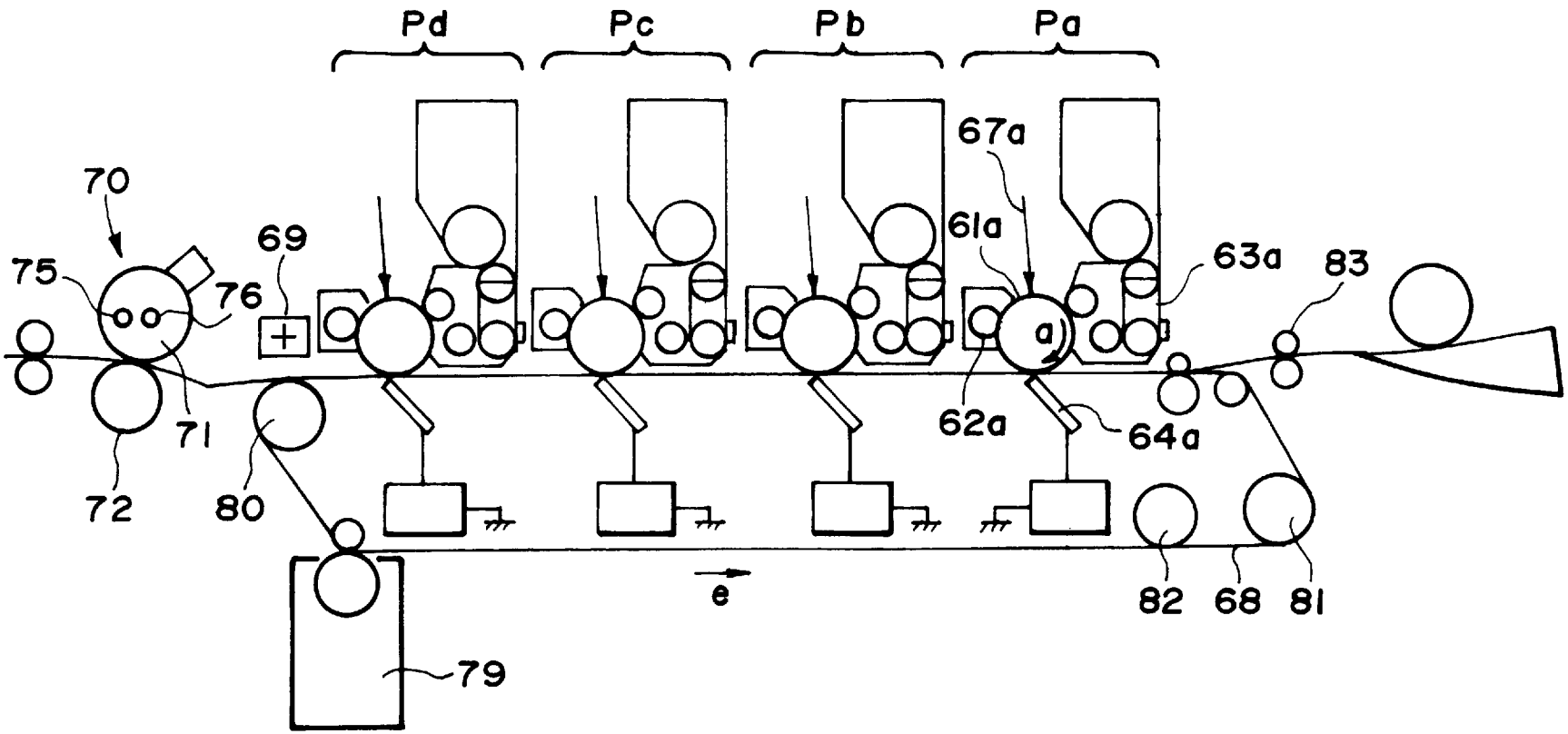
FIG. 3 illustrates a full-color image forming system.

FIG. 3 illustrates an example of full-color image forming system according to the present invention.

Referring to FIG. 3, a full-color image forming apparatus main body includes a first image forming unit Pa, a second image forming unit Pb, a third image forming unit Pc and a fourth image forming unit Pd disposed in juxtaposition for forming respectively images of difference colors each formed through a process including electrostatic image formation, development and transfer steps on a transfer material.

The organization of the image forming units juxtaposed in the image forming apparatus will now be described with reference to the first image forming unit Pa, for example.

The first image forming unit Pa includes an electrophotographic photosensitive drum 61*a* as an electrostatic image-bearing member, which rotates in an indicated arrow a direction, and a primary charger 62*a* as a charging means. The photosensitive drum 61*a* uniformly surface-charged by the primary charger 62*a* is illuminated with laser light 67*a* from an exposure means (not shown) to form an electrostatic image on the photosensitive drum 61*a*. A developing device 63*a* containing a color toner is disposed so as to develop the electrostatic image on the photosensitive drum 61*a* to form a color toner image thereon. When a two-component developer comprising the yellow toner together with a carrier is used, a magnetic brush of the developer is formed on a developing sleeve so as to brush the surface of the photosensitive drum 61*a*. On the other hand, in case where a non-magnetic monocomponent developer consisting of the yellow toner is used, the developer is carried on the developing sleeve disposed with a spacing from the photosensitive drum 61*a* and caused to jump onto the electrostatic image on the photosensitive drum 61*a* under application of an AC/DC-superposed developing bias voltage. A transfer blade 64*a* is disposed as a transfer means opposite to the photosensitive drum 61*a* for transferring a color toner image formed on the photosensitive drum 61*a* onto a surface of a transfer material (recording material) conveyed by a belt-form transfer material-carrying member 68, the transfer blade 64*a* is abutted against a back surface of the transfer material carrying member 68 to supply a transfer bias voltage thereto.

In operation of the first image forming unit Pa, the photosensitive drum 61*a* is uniformly primarily surface-charged by the primary charger 62*a* and then exposed to laser light 67*a* to form an electrostatic image thereon, which is then developed by means of the developing device 6*a* to form a color toner image. Then, the toner image on the photosensitive drum 61*a* is moved to a first transfer position where the photosensitive drum 61*a* and a transfer material abut to each other and the toner image is transferred onto the transfer material conveyed by and carried on the belt-form transfer material-carrying member 68 under the action of a transfer bias electric field applied from the transfer blade 64*a* abutted against the back-side of the transfer material-carrying member 68.

The image forming apparatus includes the second image forming unit Pb, the third image forming unit Pc and the fourth image forming unit Pd each of which has an identical organization as the above-described first image forming unit Pa but contains a toner of a different color, in juxtaposition with the first image forming unit Pa. For example, the first to fourth units Pa to Pd contain a yellow toner, a magenta toner a cyan toner and a black toner, respectively, and at the transfer position of each image forming unit, the transfer of toner image of each color is sequentially performed onto an identical transfer material while moving the transfer material once for each color toner image transfer and taking a registration of the respective color toner images, whereby superposed color images are formed on the transfer material. After forming superposed toner images of four colors on a transfer material, the transfer material is separated from the transfer material-carrying member 68 by means of a separation charger 69 and sent by a conveyer means like a transfer belt to a fixing device 70 where the superposed color toner images are fixed onto the transfer material in a single fixation step to form an objective full-color image.

The fixing device 70 includes, e.g., a pair of a 40 mm-dia. fixing roller 71 and a 30 mm-dia. pressure roller 72. The fixing roller 71 includes internal heating means 75 and 76. Yet unfixed color-toner images on a transfer material are fixed onto the transfer material under the action of heat and pressure while being passed through a pressing position between the fixing roller 71 and the pressure roller 72 of the fixing device 70.

In the apparatus shown in FIG. 3, the transfer material-carrying member 68 is an endless belt member and is moved in the direction of an indicated arrow e direction by a drive roller 80 and a follower roller 81. During the movement, the transfer belt 68 is subjected to operation of a transfer belt cleaning device 79 and a belt discharger. In synchronism with the movement of the transfer belt 68, transfer materials are sent out by a supply roller 84 and moved under the control of a pair of registration roller 83.

As transfer means, such a transfer blade abutted against the back side of a transfer material-carrying member can be replaced by other contact transfer means capable of directly supplying a transfer bias voltage while being in contact with the transfer material-carrying member.

Further, instead of the above-mentioned contact transfer means, it is also possible to use a non-contact transfer means, such as a generally used corona charger for applying a transfer bias voltage to the back side of a transfer material-carrying member.

However, in view of the suppressed occurrence of ozone accompanying the transfer bias voltage application, it is preferred to use a contact transfer means.

Next, another embodiment of the image forming method according to the present invention will be described with reference to FIG. 4.

Figure 4:
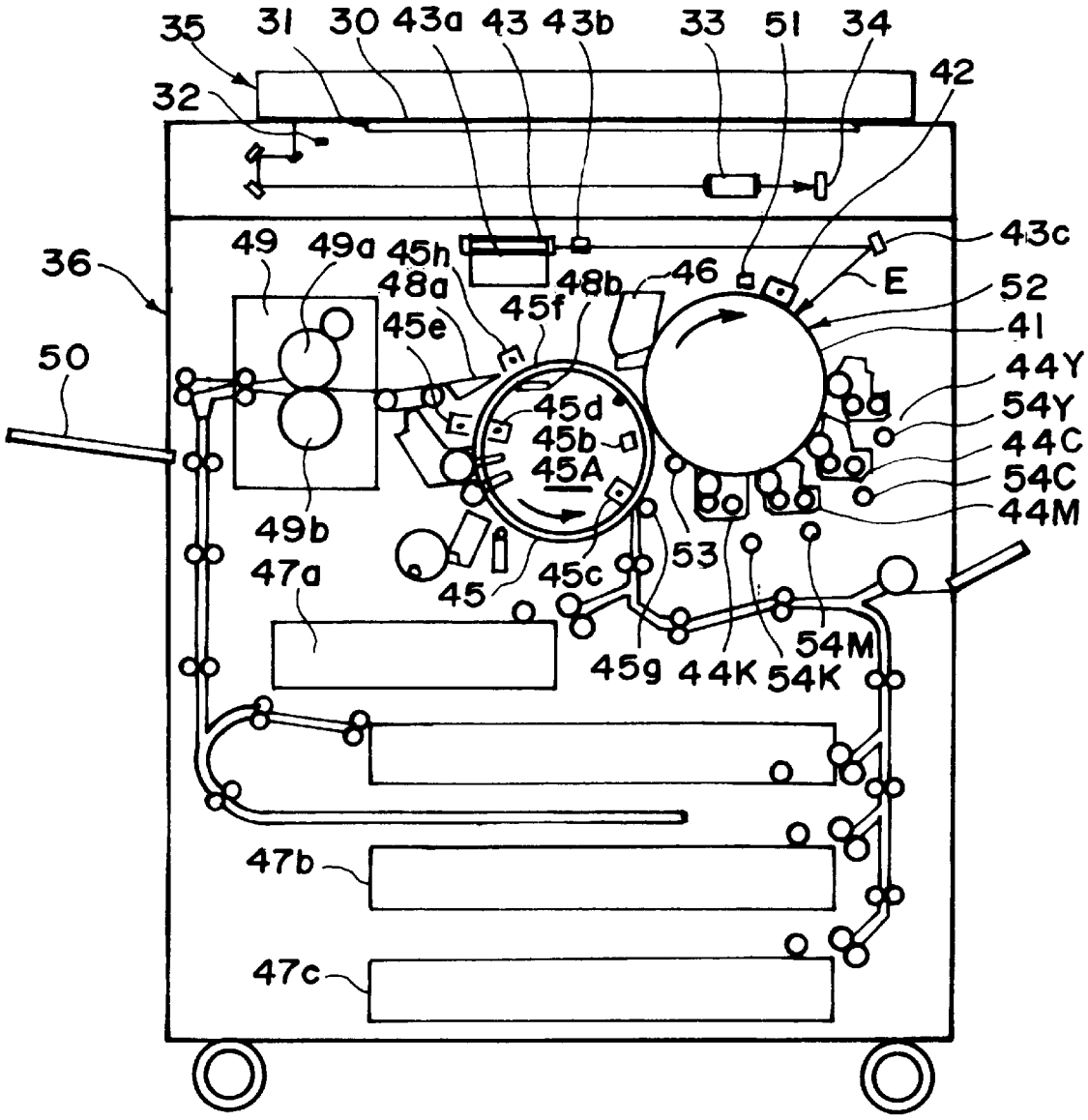
FIGS. 4 and 5 are respectively a schematic illustration of an image forming apparatus suitable for practicing another embodiment of the image forming method according to the invention.

FIG. 4 illustrates an image forming system constituted as a full-color copying system.

Referring to FIG. 4, the copying apparatus includes a digital color image reader unit 35 at an upper part and a digital color image printer unit 36 at a lower part.

In the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not shown) and is transmitted to and treated with a video-treating unit (not shown) to be outputted toward the digital image printer unit.

In the image printer unit, a photosensitive drum 1 as an electrostatic image-bearing member may, e.g., include a photosensitive layer comprising an organic photoconductor (OPC) and is supported rotatably in a direction of an arrow. Around the photosensitive drum 41, a pre-exposure lamp 51, a corona charger 42, a laser-exposure optical system 43 (43*a,* 43*b,* 43*c*), a potential sensor 52, four developing devices containing developers different in color (44Y, 44C, 44M, 44B), a luminous energy (amount of light) detection means 53, a transfer device 45A, and a cleaning device 46 are disposed.

In the laser exposure optical system 43, the image signal from the image reader unit is converted into a light signal for image scanning exposure at a laser output unit (not shown). The converted laser light (as the light signal) is reflected by a polygonal mirror 43*a* and projected onto the surface of the photosensitive drum via a lens 43*b* and a mirror 43*c*.

In the printer unit, during image formation, the photosensitive drum 41 is rotated in the direction of the arrow and charge-removed by the pre-exposure lamp 51. Thereafter, the photosensitive drum 41 is negatively charged uniformly by the charger 42 and exposed to imagewise light E for each separated color, thus forming an electrostatic latent image on the photosensitive drum 41.

Then, the electrostatic latent image on the photosensitive drum is developed with a prescribed toner by operating the prescribed developing device to form a toner image on the photosensitive drum 41. Each of the developing device 44Y, 44C, 44M and 44B performs development by the action of each of eccentric cams 24Y, 24C, 24M and 24B so as to selectively approach the photosensitive drum 41 depending on the corresponding separated color.

The transfer device 45A includes a transfer drum 45*a,* a transfer charger 45*b,* an adsorption charger 45*c* for electrostatically adsorbing a transfer material, an adsorption roller 45*g* opposite to the adsorption charger 45*c,* an inner charger 45*d,* an outer charger 45*e,* and a separation charger 45*h*. The transfer drum 45*a* is rotatably supported by a shaft and has a peripheral surface including an opening region at which a transfer sheet 45*f* as a transfer material-carrying member for carrying the recording material is integrally adjusted. The transfer sheet 45*f* may include a resin film, such as a polycarbonate film.

A transfer material is conveyed from any one of cassettes 47*a,* 47*b* and 47*c* to the transfer drum 45 via a transfer material-conveying system, and is held on the transfer drum 45. The transfer material carried on the transfer drum 45 is repeatedly conveyed to a transfer position opposite to the photosensitive drum 41 in accordance with the rotation of the transfer drum 45. The toner image on the photosensitive drum 41 is transferred onto the transfer material by the action of the transfer charger 45*b* at the transfer position.

The above image formation steps are repeated with respect to yellow (Y), magenta (M), cyan (C) and black (B) to form a color image comprising superposed four color toner images on the recording material carried on the transfer drum 45.

In the case of image formation on one surface, the recording material thus subjected to transfer of the toner image (including four color images) is separated from the transfer drum 45 by the action of a separation claw 48*a,* a separation and pressing roller 48*b* and the separation charger 5*h* to be conveyed to a heat-fixation device 49. The heat-fixation device 49 includes a heat fixing roller 49*a* containing an internal heating means and a pressure roller 49*b*. By passing between the heat fixing roller 49*a* and the pressure roller 49*b,* the full-color image carried on the transfer material is fixed onto the transfer material. Thus, in the fixing step, the toner image on the transfer material is fixed under heating and pressure to effect color-mixing and color development of the toner and fixation of the toner onto the transfer material to form a full-color fixed image (fixed full-color image), followed by discharge thereof into a tray 50. As described above, a full-color copying operation for one sheet of recording material is completed. On the other hand, a residual toner on the surface of the photosensitive drum 41 is cleaned and removed by the cleaning device 46, and thereafter the photosensitive drum 41 is again subjected to next image formation.

In the image forming method according to the present invention, it is possible to transfer a toner image formed by development of an electrostatic image on an electrostatic image-bearing member onto a transfer material via an intermediate transfer member.

Such an embodiment of the image forming method includes a step of transferring a toner image formed by development of an electrostatic image once formed on an electrostatic image-bearing member onto an intermediate transfer member, and a step of transferring the toner image once transferred to the intermediate transfer member again onto a transfer material.

Such an embodiment of the image forming method using an intermediate transfer member will now be described with reference to an image forming system shown in FIG. 5.

Figure 5:
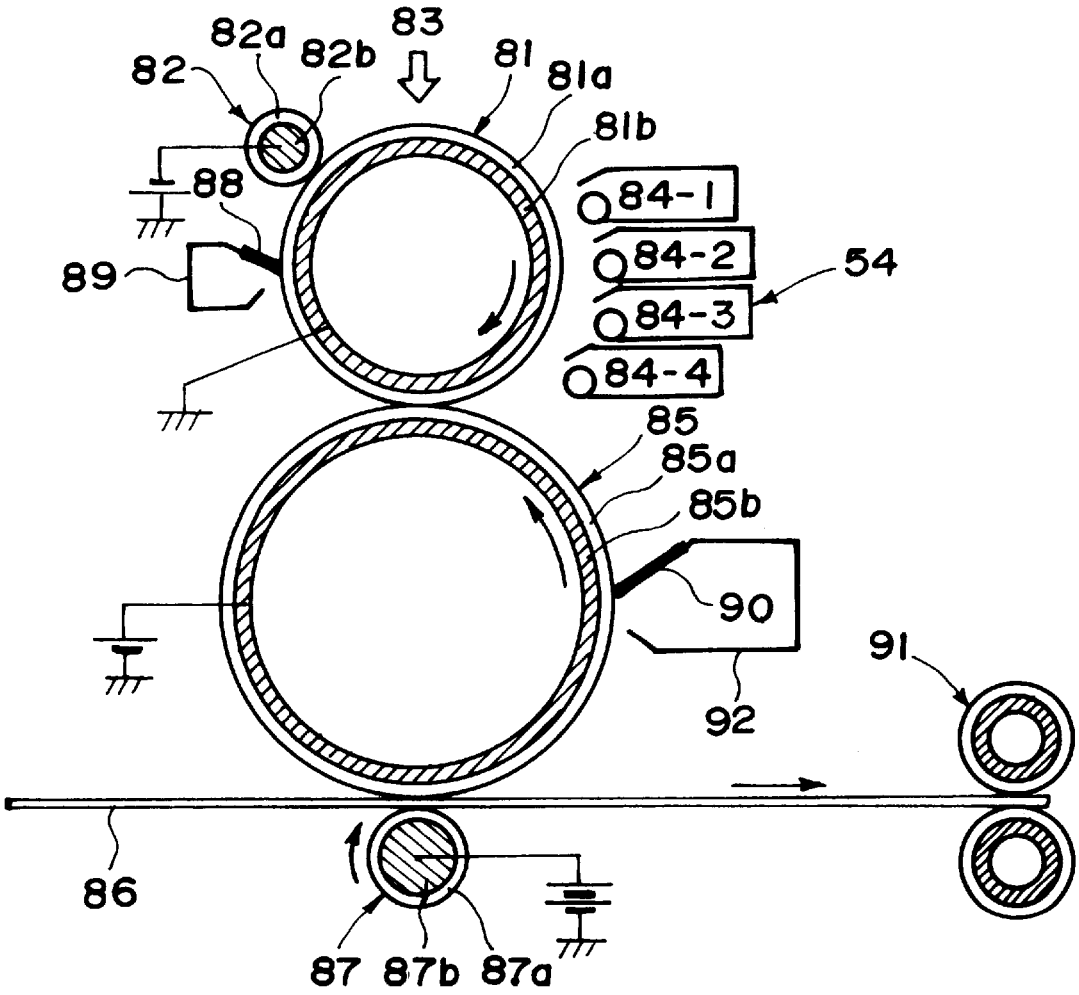

Referring to FIG. 5, the image forming system includes a cyan developing device 84-1, a magenta developing device 84-2, a yellow developing device 84-3 and a black developing device 84-4 containing a cyan developer including a cyan toner, a magenta developer including a magnetic toner, a yellow developer including a yellow toner, and a black developer including a black toner, respectively. A photosensitive member 81 as an electrostatic image-bearing member is illuminated with laser light 83 as an electrostatic latent image forming means to form an electrostatic image thereon. Such an electrostatic image is developed by one of these developers, e.g., by a magnetic brush development scheme, to form a color toner image on the photosensitive member 81.

The photosensitive member 81 comprises an electroconductive substrate 81*b* in the for of, e.g., a drum as shown, and an insulating photoconductor layer 81*a* disposed thereon comprising, e.g., amorphous selenium, cadmium sulfide, zinc oxide, organic photoconductor or amorphous silicon. The photosensitive member 81 is rotated in an indicated arrow direction by a drive means (not shown). The photosensitive member 81 may preferably comprise an amorphous silicon photosensitive layer or organic photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 81 or by using a contact charger, such as a charging roller. The contact charging system as shown in FIG. 5 may preferably be used in view of efficiency of uniform charging, simplicity and a lower ozone-generating characteristic.

The charging roller 82 as a primary charging means comprises a core metal 82*b* and an electroconductive elastic layer 82*a* surrounding a periphery of the core metal 82*b*. The charging roller 82 is pressed against the photosensitive member 81 at a prescribed pressure (pressing force) and rotated mating with the rotation of the photosensitive member 81.

The charging step using the charging roller may preferably be performed under process conditions including an applied pressure of the roller of 5–500 g/cm, an AC voltage of 0.5–5 kVpp, an AC frequency of 50 Hz–5 kHz and a DC voltage of ±0.2–±1.5 kV in the case of applying AC voltage and DC voltage in superposition.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF), polyvinylidene chloride (PVDC), or fluorine-containing acrylic resin.

The toner image formed on the electrostatic image-bearing member 81 is transferred to an intermediate transfer members 85 to which a voltage (e.g., ±0.1–±5 kV) is applied.

The intermediate transfer member 85 comprises a pipe-like electroconductive core metal 85*b* and a medium resistance-elastic layer 85*a* (e.g., an elastic roller) surrounding a periphery of the core metal 85*b*. The core metal 85*b* can comprise a plastic pipe coated by electroconductive plating. The medium resistance-elastic layer 85*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm.

The intermediate transfer member 85 is disposed under the electrostatic image-bearing member 81 so that it has an axis (or a shaft) disposed in parallel with that of the electrostatic image-bearing member 81 and is in contact with the electrostatic image-bearing member 81. The intermediate transfer member 85 is rotated in the direction of an arrow (counterclockwise direction) at a peripheral speed identical to that of the electrostatic image-bearing member 81.

The respective color toner images are successively intermediately transferred to the peripheral surface of the intermediate transfer member 85 by an elastic field formed by applying a transfer bias to a transfer nip region between the electrostatic image-bearing member 81 and the intermediate transfer member 85 at the time of passing through the transfer nip region.

Transfer residual toner remaining on the photosensitive member 81 without being transferred onto the intermediate transfer member is cleaned by a cleaning member 88 for the photosensitive member to be recovered in a cleaner vessel 89.

The transfer means (e.g., a transfer roller) 87 is disposed under the intermediate transfer member 85 so that it has an axis (or a shaft) disposed in parallel with that of the intermediate transfer member 85 and is in contact with the intermediate transfer member 85. The transfer means (roller) 87 is rotated in the direction of an arrow (clockwise direction) at a peripheral speed identical to that of the intermediate transfer member 85. The transfer roller 87 may be disposed so that it is directly in contact with the intermediate transfer member 85 or in contact with the intermediate transfer member 85 via a belt, etc. The transfer roller 87 may comprise an electroconductive elastic layer 87*a* disposed on a peripheral surface of a core metal 87*b*.

The intermediate transfer member 85 and the transfer roller 87 may comprise known materials as generally used. By setting the volume resistivity of the elastic layer 85*a* of the intermediate transfer member 85 to be higher than that of the elastic layer 87*b* of the transfer roller 87, it is possible to alleviate a voltage applied to the transfer roller 87. As a result, a good toner image is formed on the transfer-receiving material and the transfer-receiving material is prevented from winding about the intermediate transfer member 85. The elastic layer 85*a* of the intermediate transfer member 85 may preferably have a volume resistivity at least ten times that of the elastic layer 87*b* of the transfer roller 87.

The hardness of the intermediate transfer member and the transfer roller may be measured according to JIS K6301. More specifically, the intermediate transfer member may preferably comprise an elastic layer having a hardness of 10–40 deg., and the transfer roller may preferably comprise an elastic layer having a hardness of 41–80 deg. harder than that of the elastic layer of the intermediate transfer member, so as to prevent the winding of a transfer material about the intermediate transfer roller. If the relative hardness of the intermediate transfer member and the transfer roller are reversed, concavities are liable to be formed on the transfer roller, thus promoting the winding of the transfer material about the intermediate transfer member.

The transfer roller 87 is rotated at a peripheral speed which may be identical or different from that of the intermediate transfer member 85. A transfer material 86 is conveyed to a transfer position between the intermediate transfer member 88 and the transfer roller 87, and simultaneously therewith, the transfer roller 87 is supplied with a bias voltage of a polarity opposite to that of the triboelectric charge of the toner from a transfer bias voltage supply means, whereby a toner image on the intermediate transfer member 85 is transferred onto a front-side surface of the transfer material 86.

Transfer residual toner remaining on the intermediate transfer member 85 without being transferred onto the transfer material 86 is cleaned by a cleaning member 90 for the intermediate transfer member and removed in a cleaning vessel 92. The toner image transferred onto the transfer material 86 is fixed onto the transfer material 86 when passing through a heat-fixing device 91.

The transfer roller 87 may comprise similar materials as those of the charging roller 52. Preferred transfer condition may include a roller abutting pressure of 2.94–490 N/m (3–500 g/cm), more preferably 19.6–294 N/m, and a DC voltage of ±0.2–±10 kV. If the abutting pressure is below 2.94 N/m, the conveyance deviation or transfer failure of transfer material is liable to occur.

The electroconductive elastic layer 87*a* of the transfer roller 87 is formed as a solid or foam layer having a medium level of (volume) resistivity of $10^6$–$10^{10}$ ohm.cm of an elastic material, such as polyurethane rubber, or EPDM (ethylene-propylene-diene terpolymer) containing an electroconductivity-imparting material, such as carbon black, zinc oxide, tin oxide or silicon carbide, dispersed therein.

EXAMPLES

The present invention will be described more specifically based on Examples.

Toner Production Example 1

Into a 2-liter four-necked flask equipped with a high-speed stirrer ("TK-Homomixer", available from Tokushu Kika Kogyo K.K.), 510 wt. parts of deionized water and 450 wt. parts of 0.1 mol/liter-$Na_3PO_4$ aqueous solution were placed and stirred at 10,000 rpm at 60° C. Into the system under stirring, 68 wt. parts of 1.0 mol/liter-$CaCl_2$ aqueous solution was gradually added to form an aqueous dispersion medium containing minute particles of hardly water-soluble dispersant $Ca_3(PO_4)_2$. On the other hand, a disperse system was formed from the following ingredients.

| | |
|---|---|
| Styrene monomer | 165 wt. parts |
| n-Butyl acrylate monomer | 35 wt. parts |
| C.I. Pigment Yellow 93 | 8 wt. parts |
| C.I. Solvent Yellow 162 | 8 wt. parts |
| Linear polyester resin (formed from phthalic acid and propylene oxide-modified bisphenol A) | 10 wt. parts |
| Dialkylsalicylic acid aluminum (Al) compound | 2 wt. parts |
| Divinylbenzene | 0.5 wt. parts |
| Ester wax No. 5 (Mw = 450, Mn = 400, Mw/Mn = 1.13, melting point (Tm) = 68° C., viscosity = 6.1 mPa · S, Vickers hardness (HV) = 1.2, SP = 8.3) | 10 wt. parts |

The above ingredients were dispersed for 3 hours by an attritor, and 4.0 wt. parts of lauroyl peroxide (polymerization initiator) were added thereto to form a polymerizable monomer mixture (disperse system), which was then dispersed in the above-prepared dispersion medium under stirring at 10000 rpm for 3 minutes to form droplets. Thereafter, the high-speed stirrer was replaced with a propeller blade stirrer, and polymerization was performed under stirring at 60 rpm for 10 hours at 60° C. After the polymerization, the slurry was cooled and dilute hydrochloric acid was added to remove the dispersant. The polymerizate particles was further washed and dried to obtain yellow toner particles having a weight-average particle size (D4) of 6.5 μm.

The toner particles exhibited an acid value of 4.5 mgKOH/g. 100 wt. parts of the toner particles and 1.5 wt. parts of hydrophobic silica were blended by a Henschel mixer to obtain Yellow toner (1), which exhibited an acid value of 4.5 mgKOH/g.

Yellow toner (1) was found to contain 4 wt. parts of C.I. Pigment Yellow 93 and 4 wt. parts of C.I. Solvent Yellow 162 per 100 wt. parts of the binder resin.

Toner Production Example 2

Yellow toner particles having a weight-average particle size of 6.7 μm were prepared in the same manner as in Production Example 1 except for changing the amounts of the colorants in the polymerizable monomer mixture as follows.

| | |
|---|---|
| C.I. Pigment Yellow 93 | 6 wt. part(s) |
| C.I. Pigment Yellow 162 | 1 wt. part(s) |

The yellow toner particles were blended with hydrophobic silica in the same manner as in Production Example 1 to obtain Yellow toner (2).

Toner Production Example 3

Yellow toner particles having a weight-average particle size of 6.2 μm were prepared in the same manner as in Production Example 1 except for changing the amounts of the colorants in the polymerizable monomer mixture as follows.

| | |
|---|---|
| C.I. Pigment Yellow 93 | 1 wt. part(s) |
| C.I. Pigment Yellow 162 | 4 wt. part(s) |

The yellow toner particles were blended with hydrophobic silica in the same manner as in Production Example 1 to obtain Yellow toner (3).

Toner Production Example 4

Yellow toner particles having a weight-average particle size of 7.1 μm were prepared in the same manner as in Production Example 1 except for changing the amounts of the colorants in the polymerizable monomer mixture as follows.

| | |
|---|---|
| C.I. Pigment Yellow 128 | 6 wt. part(s) |
| C.I. Pigment Yellow 162 | 6 wt. part(s) |

The yellow toner particles were blended with hydrophobic silica in the same manner as in Production Example 1 to obtain Yellow toner (4).

Toner Production Example 5

| | |
|---|---|
| Linear polyester resin (Tg = 59° C., acid value = 12; formed from phthalic acid, propylene oxide modified bisphenol A and trimellitic acid) | 100 wt. parts |
| C.I. Pigment Yellow 93 | 3 wt. parts |
| C.I. Solvent Yellow 162 | 3 wt. parts |
| Dialkylsalicylic acid Al compound | 2 wt. parts |
| Ester wax No. 5 | 2 wt. parts |

The above ingredients were subjected to melt-kneading, pulverization and classification to obtain yellow toner particles having a weight-average particle size (D4) of 6.5 μm. Then, 100 wt. parts of the toner particles were blended with 1.5 wt. parts of hydrophobic silica by means of a Henschel mixer similarly as in Production Example 1 to obtain Yellow toner (5).

Toner Production Example 6

Yellow toner (6) was prepared in the same manner as in Production Example 5 except for replacing the linear polyester resin (as the binder resin) with 100 wt. parts of styrene-butyl acrylate-maleic acid resin (Tg=63° C., acid value=21 mgKOH/g).

Toner Production Example 7

Yellow toner particles (D4=7.2 μm) were prepared in the same manner as in Production Example 1 except for omitting the dialkylsalicylic acid Al compound from the polymerizable monomer mixture. The toner particles were blended with hydrophobic silica in the same manner as in Production Example 1 to obtain Yellow toner (7).

Toner Production Example 8

Yellow toner particles (D4=5.8 μm) having a somewhat broad particle size distribution were prepared in the same manner as in Production Example 1 except for increasing the amount of the dialkylsalicylic acid Al compound to 22 wt. parts. The toner particles were then classified to provide toner particles (D4=6.2 μm), which were blended with hydrophobic silica in the same manner as in Production Example 1 to obtain Yellow toner (8).

Toner Production Example 9

Yellow toner particles (D4=7.9 μm) were prepared in the same manner as in Production Example 1 except for replacing the ester wax with 8 wt. parts of polypropylene wax. The toner particles-were blended with hydrophobic silica in the same manner as in Production Example 1 to obtain Yellow toner (9).

Comparative Toner Production Example 1

Yellow toner particles (D4=7.2 μm) were prepared in the same manner as in Production Example 1 except for replacing the colorant with 8 wt. parts of C.I. Pigment Yellow 93 alone. The toner particles were blended with hydrophobic silica in the same manner as in Production Example 1 to obtain Comparative Yellow toner (i).

Comparative Toner Production Example 2

Yellow toner particles (D4=5.9 μm) having a somewhat broad particle size distribution were prepared in the same manner as in Production Example 1 except for omitting the C.I. Pigment Yellow 93, and classified to provide D4=6.2 μm. The toner particles were then blended with hydrophobic silica in the same manner as in Production Example 1 to obtain Comparative Yellow toner (ii).

Example 1

7 wt. parts of Yellow toner (1) was blended with 93 wt. parts of acrylic resin-coated ferrite carrier to obtain a developer. The developer was evaluated for forming yellow monochromatic images by using a full-color copying machine (including a 180 mm-dia. photosensitive drum and a 25 mm-dia. developing sleeve providing an outer diameter ratio of 7.2:1) obtained by remodeling a commercially available machine ("CLC700", mfd. by Canon K.K.) so as to allow variable fixing temperatures, include a pair of fixing rollers each surfaced with a fluorine-containing resin and omit the fixing oil-application mechanism.

The fixed toner images were formed on transfer paper (plain paper) and transparency film, respectively, as transfer materials in the following manner.

Unfixed toner images having a gradation were formed in an environment of temperature 23° C./humidity 65% RH by development at a developing contrast of 320 volts and transferred onto transfer materials, and then fixed through an external fixing device including a fixing roller having a diameter of 40 mm and surfaced with a fluorine-containing resin and including no oil application means at a fixing temperature of 180° C. and at process speed of 90 mm/sec for transfer papers and 30 mm/sec for transparency films to form-fixed images.

The resultant fixed images were evaluated with respect to the following items.

(1) L* (lightness), C* (saturation) and H* (hue angle)

These parameters representing coloring characteristics were quantitatively measured according to the definition of calorimetric system standardized by CIE (International Illumination Committee) in 1976. The measurement was performed by using a spectral colorimeter ("Type 938", made by X-Rite Co.) and a C-light source as a light source for observation at a viewing angle of 2 deg.

The lightness (L*), saturation (C*) and hue angle (H ) of images on transfer paper are transmission images on transparency films with respect to portions of fixed images having a solid image density of 1.3. The measured values were substituted in the following CMC (1:1) chromaticity difference formula proposed in Journal of the Society of Dyers and Colourists, 100, 128 (1984) for evaluation of ΔE (chromaticity difference) based on lightness L*, saturation C* and hue angle H* with correction of visual sensitivity:

$$\Delta E=[(\Delta L^*/ISL)^2+(\Delta C^*/CSC)^2+(\Delta H^*/SH)^2]^{1/2},$$

wherein ISL denotes a correction factor for lightness ΔL, CSC, a correction factor for saturation ΔC*; and SH, a correction factor for hue angle ΔH*.

The calculated values of ΔE (chromaticity difference) were normalized by taking that of Comparative Example 1 described hereinafter so 100 and evaluated according to the following standard:

A: $\Delta E \leqq 80$

B: $80<\Delta E \leqq 90$

C: $90 \leqq \Delta E \leqq 100$

D: $100<\Delta E \leqq S\ 110$

E: $\Delta E>110$ (2) Light-fastness (L.F.)

Light-fastness was evaluated by using a fade meter whereby a solid image having an image density of was exposed to a carbon arc lamp for 40 hours and then a lowering in image density was measured.

(3) Charging stability and environmental stability (E.D.)

The developer was used for continuous image formation by the above-mentioned copying machine on 3000 sheets in a normal temperature/low humidity environment (20 ° C./5% RH). The developers after formation on 10 sheets and 3000 sheets, and the developer after further 3 days of standing and 5 minutes of shaking, were subjected to charge measurement to evaluate charge stability during continuous image formation. Further, for evaluating the environmental stability (E.D.), the developer taken out of the developing device was separately left standing for 2 days in environments of high temperature/high humidity (30° C./80% RH) and low temperature/low humidity (15° C./10% RH), respectively, followed by 5 minutes of shaking and subjected to charge measurement. The environmental stability was evaluated as a difference (E.D.) between charges measured for the respective environments.

Figure 6:
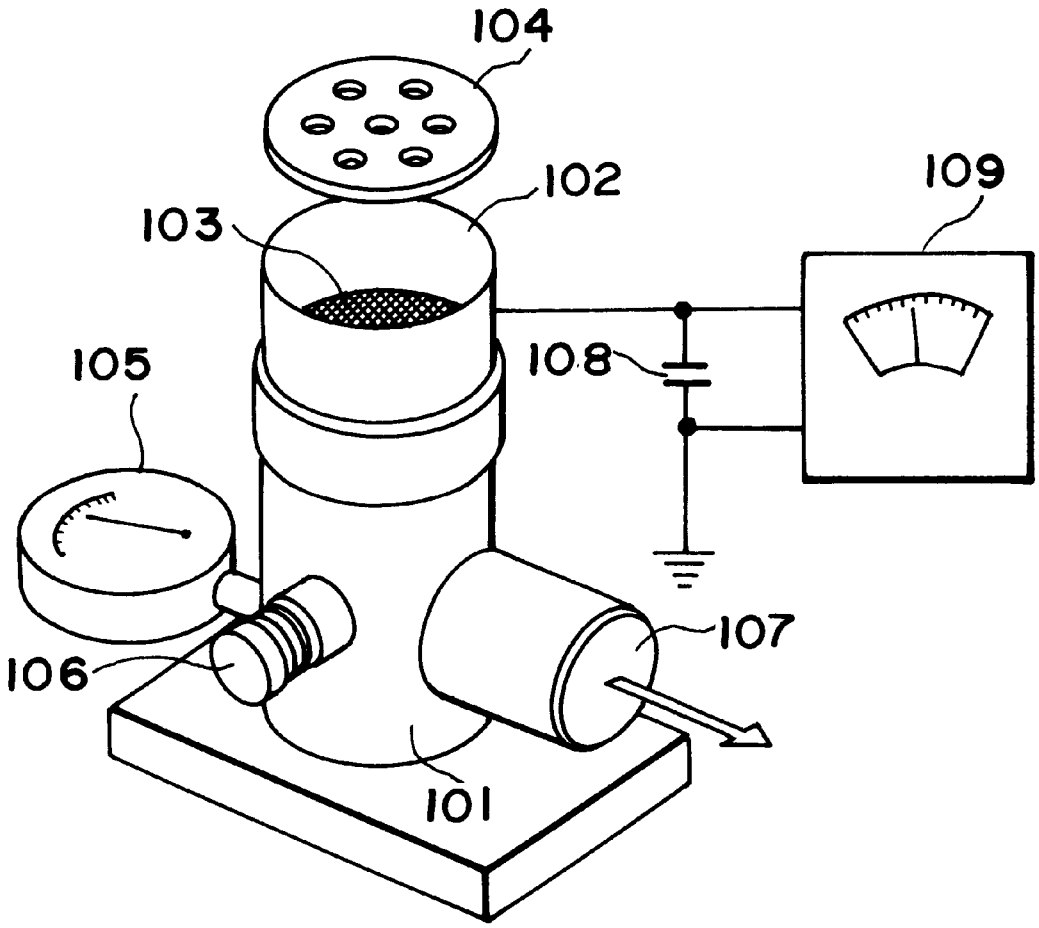
FIG. 6 illustrates an apparatus for measuring a triboelectric chargeability.

The charge of each developer sample (taken out of the developing device, optionally further standing and shaking)

was measured in the following manner by using an apparatus shown in FIG. 6.

Each developer sample in a weight of $W_0$ (=ca. 0.5–1.5 g) is placed in a metal measurement vessel 102 bottomed with a 500-mesh screen 103. The weight of the entire measurement vessel 102 at this time is weighed at $W_1$ (g). Then, an aspirator 101 (composed of an insulating material at least with respect to a portion contacting the measurement vessel 102) is operated to suck the toner through a suction port 107 while adjusting a gas flow control valve 106 to provide a pressure of 2450 hPa at a vacuum gauge 105. Under this state, the toner is sufficiently removed by sucking for 2 min.

The potential reading on a potentiometer 109 is denoted by V (volts) while the capacitance of a capacitor 108 is denoted by C ($\mu$F) and the weight of the entire measurement vessel is weighed at $W_2$ (g). Then, the triboelectric charge Q (mC/kg) of the toner contained at a concentration of T (−) in the developer is calculated by the following equation:

$$Q = \frac{(W_1 - W_2)}{TxW_0} \times \frac{CxV}{(W_1 - W_2)} = \frac{CxV}{TxW_0}$$

(4) Fog

Fog on an image sheet formed on a 3000-th sheet during the continuous image formation in the environment of normal temperature/low humidity (20° C./5% RH).

The fog value was measured as a difference Ds−Dr based on an average reflection density Dr of a blank paper before the image formation and the largest reflection density Ds at the white background portion on the image sheet, respectively measured by using a reflection densitometer ("REFLECTOMETER MODEL TC-6DS", made by Tokyo Denshoku K.K.). A fog value of at most 2% represents a good image substantially free of fog, and a fog value of 5% represents an unclear image with noticeable fog.

(5) Transmission image evaluation for transparency

A transmittance of a portion of the fixed image having an image density of 0.4–0.6 was measured at an absorption wavelength of 600 nm with a transmittance of the blank transparency film as 100% by using an auto-spectrophotometer ("UV2200", made by Shimazu Seisakusho K.K.). Based on the measured transmittance value Tr (%), the evaluation was performed according the following standard.

A: Tr≧80%

B: 65%≦Tr<80%

C: 50%≦Tr<65%

D: Tr<50%

Color space measurement was performed by forming a transmission image of a fixed image by means of an overhead projector ("OHP 9550", made by 3M Co.), projecting the transmission image on a white wall, and measuring the hue angle H* (OHP) of the projected image by a spectral emission luminance meter ("PR650", made by Photo Research Co.) to calculate an angle difference ΔH*=H* (OHP)−H* (paper) with a hue angle H* (paper) at a solid image portion of the corresponding image formed on transfer paper. The evaluation was performed based on the values of ΔH* according to the following standard.

A: ΔH*≦5

B: 5<ΔH*≦10

C: 10<ΔH*≦20

D: 20<ΔH*≦30

E: ΔH*>30

The results of the above evaluation and measurement obtained by the developer including Yellow toner (1) of Example 1 are inclusively shown in Table 1.

Examples 2–9 and Comparative Examples 1 and 2

Developers were prepared and evaluated in the same manner as in Example 1 except for using Yellow Toners (2) to (9) and Comparative Yellow toners (i) and (ii). The results are also inclusively shown in Table 1.

TABLE 1

| | Toner | | | | | | Evaluation Results | | | | | | | | | | |
|---|---|---|---|---|---|---|---|---|---|---|---|---|---|---|---|---|---|
| | | Colorant | | | | | On transfer paper | | | | Charge (mC/kg) | | | | | | |
| Ex. & Comp. Ex. | No. | C.I. Pigment No./ C.I. Solvent No. | Added (wt. parts) | Acid value (mgKOH/g) | $D_4$ ($\mu$m) | Colorant content (wt. parts) | L* | C* | ΔE | L.F. | after 10 sheets | after 3000 sheets | after 3 days stand | E.D. | Fog | Transparency Tr | ΔH* |
| Ex. 1 | (1) | P.93/S.162 | 4/4 | 4.5 | 6.5 | 4/4 | 100 | 80 | A | 0.15 | −28.1 | −27.5 | −25.9 | 3.7 | 0.7 | A | A |
| Ex. 2 | (2) | P.93/S.162 | 3/0.5 | 4.5 | 6.7 | 3/0.5 | 90 | 76 | B | 0.12 | −25.1 | −29.3 | −23.1 | 4.1 | 0.9 | B | B |
| Ex. 3 | (3) | P.93/S.162 | 0.5/2 | 4.5 | 6.2 | 0.5/2 | 96 | 83 | A | 0.24 | −24.2 | −20.1 | −20.1 | 4.8 | 2.3 | A | A |
| Ex. 4 | (4) | P.128/S.162 | 3/3 | 4.5 | 7.1 | 3/3 | 93 | 73 | B | 0.14 | −25.3 | −24.5 | −21.2 | 5.4 | 2.0 | A | B |
| Ex. 5 | (5) | P.93/S.162 | 3/3 | 12.1 | 6.5 | 3/3 | 100 | 80 | A | 0.15 | −26.2 | −30.7 | −26.9 | 16.2 | 1.0 | A | A |
| Ex. 6 | (6) | P.93/S.162 | 3/3 | 20.7 | 7.1 | 3/3 | 100 | 80 | A | 0.15 | −27.4 | −27.0 | −26.0 | 10.6 | 1.5 | A | A |
| Ex. 7 | (7) | P.93/S.162 | 4/4 | 4.5 | 7.2 | 4/4 | 94 | 77 | A | 0.15 | −27.9 | −23.6 | −23.3 | 8.1 | 1.8 | A | A |
| Ex. 8 | (8) | P.93/S.162 | 4/4 | 4.5 | 6.2 | 4/4 | 100 | 80 | A | 0.15 | −28.2 | −33.2 | −28.4 | 2.7 | 1.3 | A | A |
| Ex. 9 | (9) | P.93/S.162 | 4/4 | 4.5 | 7.9 | 4/4 | 90 | 78 | B | 0.15 | −27.8 | −26.0 | −26.0 | 3.9 | 1.1 | A | B |
| Comp. Ex. 1 | (i) | P.93/— | 4/0 | 4.5 | 7.2 | 4/0 | 80 | 56 | C | 0.38 | −12.3 | −35.9 | −18.0 | 11.2 | 1.5 | C | C |
| Comp. Ex. 2* | (ii) | —/S.162 | 0/4 | 4.5 | 6.2 | 0/4 | 94 | 82 | A | 0.87 | −15.2 | −8.6 | −6.7 | 22.1 | 9.2 | A | A |

*The fixing roller inspected after the continuous image formation on 3000 sheets in Comparative Example 2 exhibited a trace of dyeing with the colorant.

Toner Production Example 10

Into a 2-liter four-necked flask equipped with a high-speed stirrer ("TK-Homomixer", available from Tokushu Kika Kogyo K.K.), 710 wt. parts of deionized water and 550 wt. parts of 0.1 mol/liter-$Na_3PO_4$ aqueous solution were placed and stirred at 10,000 rpm at 65° C. Into the system under stirring, 68 wt. parts of 1.0 mol/liter-$CaCl_2$ aqueous solution was gradually added to form an aqueous dispersion medium containing minute particles of hardly water-soluble dispersant $Ca_3(PO_4)_2$. On the other hand, a disperse system was formed from the following ingredients.

| | |
|---|---|
| Styrene monomer | 160 wt. parts |
| n-Butyl acrylate monomer | 40 wt. parts |
| C.I. Pigment Yellow 180 | 2 wt. parts |
| C.I. Solvent Yellow 162 | 6 wt. parts |
| Saturated polyester resin (formed from terephthalic acid and propylene oxide-modified bisphenol A; acid value (A.V.) = 8 mgKOH/g, peak molecular weight (Mp) = 7000) | 10 wt. parts |
| Salicylic acid aluminum (Al) compound | 2 wt. parts |
| Ester wax No. 5 (Mw = 450, Mn = 400, Mw/Mn = 1.13, melting point (Tm) = 68° C., viscosity = 6.1 mPa · S, Vickers hardness (HV) = 1.2, SP = 8.3) | 20 wt. parts |

The above ingredients were dispersed for 3 hours by an attritor, and 2 wt. parts of 2,2'-azobis(2,4-dimethylvaleronitrile (polymerization initiator) were added thereto to form a polymerizable monomer mixture (disperse system), which was then dispersed in the above-prepared dispersion medium under stirring at 10000 rpm for 8 minutes to form droplets. Thereafter, the high-speed stirrer was replaced with a propeller blade stirrer, and polymerization was performed at 50 rpm, for 4 hours at 60° C. and then for 4 hours at 80° C., for totally 8 hours. After the polymerization, the slurry was cooled and dilute hydrochloric acid was added to remove the dispersant. The polymerizate particles was further washed and dried to obtain yellow toner particles having a weight-average particle size (D4) of 6.6 μm.

The toner particles exhibited an acid value of 3.9 mgKOH/g.

100 wt. parts of the yellow toner particles prepared above were respectively blended with 2 wt. parts of hydrophobized titanium oxide to obtain Yellow toner (10).

Yellow toner (10) exhibited an acid value of 3.9 mgKOH/g and was found to contain 1 wt. part of C.I. Pigment Yellow 180 and 3 wt. parts of C.I. Solvent Yellow 162 per 100 wt. parts of the binder resin.

Toner Production Example 11

| | |
|---|---|
| Styrene monomer | 170 wt. parts |
| 2-Ethylhexyl acrylate monomer | 30 wt. parts |
| C.I. Pigment Yellow 180 | 4 wt. parts |
| C.I. Pigment Yellow 162 | 4 wt. parts |
| Salicylic Al compound | 3 wt. parts |
| Saturated polyester resin (formed from terephthalic and propylene oxide-modified bisphenol A; A.V. = 10 mgKOH/g, Mp = 9100) | 10 wt. parts |
| Ester wax (Mw = 500, Mn = 400, Mw/Mn = 1.25, Tm = 70° C., viscosity = 6.5 mPa · S, Hv = 1.1, SP = 8.6) | 40 wt. parts |

Yellow toner particles were prepared in the same manner as in Production Example 10 except for using the above ingredients and blended with hydrophobized titanium oxide in the same manner as in Production Example 10 to prepare Yellow toner (11).

Toner Production Example 12

| | |
|---|---|
| Polyester resin (Mn = 2300, Mw = 22000, Tg = 59° C., acid value = 9 mgKOH/g; formed from propoxidized bisphenol A, fumaric acid and trimellitic acid) | 100 wt. parts |
| C.I. Pigment Yellow 180 | 4 wt. parts |
| C.I. Solvent Yellow 162 | 4 wt. parts |
| Salicylic acid Al compound | 3 wt. parts |
| Ester wax No. 5 | 20 wt. parts |

The above ingredients were subjected to melt-kneading, pulverization and classification to obtain yellow toner particles having a weight-average particle size (D4) of 6.8 μm. Then, the toner particles were blended with hydrophobized titanium oxide similarly as in Production Example 10 to obtain Yellow toner (12).

Toner Production Example 13

Yellow toner particles having a weight-average particle size of 6.4 μm were prepared in the same manner as in Production Example 10 except for changing the amounts of the colorants in the polymerizable monomer mixture as follows.

| | |
|---|---|
| C.I. Pigment Yellow 180 | 3.5 wt. part(s) |
| C.I. Pigment Yellow 162 | 10.5 wt. part(s) |

The yellow toner particles were blended with hydrophobic titanium oxide in the same manner as in Production Example 10 to obtain Yellow toner (13).

Toner Production Example 14

Yellow toner particles having a weight-average particle size of 6.0 μm were prepared in the same manner as in Production Example 10 except for changing the amounts of the colorants in the polymerizable monomer mixture as follows.

| | |
|---|---|
| C.I. Pigment Yellow 180 | 1 wt. part(s) |
| C.I. Pigment Yellow 162 | 8 wt. part(s) |

The yellow toner particles were blended with hydrophobic titanium oxide in the same manner as in Production Example 10 to obtain Yellow toner (14).

Toner Production Example 15

| | |
|---|---|
| Styrene monomer | 125 wt. parts |
| Methyl methacrylate | 35 wt. parts |
| n-Butyl acrylate monomer | 40 wt. parts |
| C.I. Pigment Yellow 180 | 3.2 wt. parts |
| C.I. Pigment Yellow 162 | 3.2 wt. parts |
| Salicylic Al compound | 3 wt. parts |
| Saturated polyester resin (formed from terephthalic and propylene oxide-modified bisphenol A; A.V. = 10 mgKOH/g, Mp = 9100) | 10 wt. parts |
| Ester wax No. 5 | 40 wt. parts |

Yellow toner particles were prepared in the same manner as in Production Example 10 except for using the above ingredients and blended with hydrophobized titanium oxide in the same manner as in Production Example 10 to prepare Yellow toner (15).

Toner Production Example 16

Yellow toner particles were prepared in the same manner as in Production Example 10 except for using salicylic acid chromium compound instead of the salicylic acid aluminum compound. The toner particles were blended with hydrophobic titanium oxide in the same manner as in Production Example 10 to prepare Yellow toner (16).

Toner Production Example 17

Yellow toner particles were prepared in the same manner as in Production Example 10 except for using 8 wt. parts of polypropylene wax instead of Ester wax No. 5. The toner particles were blended with hydrophobic titanium oxide in the same manner as in Production Example 10 to prepare Yellow toner (17).

Toner Production Example 18

Yellow toner particles were prepared in the same manner as in Production Example 10 except for changing the colorants in the polymerizable monomer mixture as follows.

| | |
|---|---|
| C.I. Pigment Yellow 181 | 1.6 wt. part(s) |
| C.I. Pigment Yellow 162 | 6.4 wt. part(s) |

The yellow toner particles were blended with hydrophobic titanium oxide in the same manner as in Production Example 10 to obtain Yellow toner (18).

Comparative Toner Production Example 3

Yellow toner particles (D4=12.1 μm) having a somewhat broad particle size distribution were prepared in the same manner as in Production Example 10 except for omitting the C.I. Solvent Yellow 162, and classified to provide D4=6.7 μm. The toner particles were then blended with hydrophobic titanium oxide in the same manner as in Production Example 10 to obtain Comparative Yellow toner (iii).

Comparative Toner Production Example 4

Yellow toner particles (D4=8.4 μm) having a somewhat broad particle size distribution were prepared in the same manner as in Production Example 10 except for omitting the C.I. Pigment Yellow 180, and classified to provide D4=6.8 μm. The toner particles were then blended with hydrophobic titanium oxide in the same manner as in Production Example 10 to obtain Comparative Yellow toner (iv).

Examples 10–18 and Comparative Examples 3 and 4

Developers were prepared in the same manner as in Example 1 except for using Yellow toners (10)–(18) and Comparative Yellow toners (iii) and (iv); respectively, and were subjected to image formation and evaluation in the same manner as in Example 1. The results are inclusively shown in the following Table 2.

TABLE 2

| | Toner | | | | | | Evaluation Results | | | | | | | | | | |
|---|---|---|---|---|---|---|---|---|---|---|---|---|---|---|---|---|---|
| | Colorant | | | | | | On transfer paper | | | | Charge (mC/kg) | | | | | Transparency | |
| Ex. & Comp. Ex. | No. | C.I. Pigment No./ C.I. Solvent No. | Added (wt. parts) | Acid value (mgKOH/g) | $D_4$ (μm) | Colorant content (wt. parts) | L* | C* | ΔE | L.F. | after 10 sheets | after 3000 sheets | after 3 days stand | E.D. | Fog | Tr | ΔH* |
| Ex. 10 | (10) | P.180/S.162 | 1/3 | 3.9 | 6.6 | 1/3 | 101 | 75 | A | 0.28 | −27.1 | −31.1 | −25.0 | 4.7 | 1.0 | A | A |
| Ex. 11 | (11) | P.180/S.162 | 2/2 | 4.5 | 7.4 | 2/2 | 106 | 76 | B | 0.15 | −23.1 | −27.4 | −21.1 | 4.3 | 1.1 | A | A |
| Ex. 12 | (12) | P.180/S.162 | 4/4 | 9.0 | 6.8 | 4/4 | 109 | 82 | B | 0.20 | −24.0 | −26.0 | −23.0 | 12.0 | 0.9 | A | A |
| Ex. 13 | (13) | P.180/S.162 | 1.75/5.25 | 4.5 | 6.4 | 1.75/5.25 | 106 | 83 | A | 0.26 | −24.3 | −30.2 | −26.4 | 4.6 | 1.2 | A | A |
| Ex. 14 | (14) | P.180/S.162 | 0.5/4 | 4.5 | 6.0 | 0.5/4 | 107 | 86 | A | 0.34 | −24.1 | −22.3 | −19.6 | 7.2 | 1.6 | A | A |
| Ex. 15 | (15) | P.180/S.162 | 1.6/1.6 | 6.2 | 6.8 | 1.6/1.6 | 106 | 76 | B | 0.18 | −20.7 | −23.0 | −18.5 | 5.1 | 3.8 | A | A |
| Ex. 16 | (16) | P.180/S.162 | 1/3 | 4.0 | 6.7 | 1/3 | 101 | 75 | A | 0.28 | −27.4 | −31.0 | −25.7 | 5.1 | 1.0 | A | A |
| Ex. 17 | (17) | P.181/S.162 | 1/3 | 3.9 | 6.8 | 1/3 | 102 | 75 | B | 0.28 | −27.2 | −26.5 | −26.5 | 4.9 | 1.5 | A | B |
| Ex. 18 | (18) | P.181/S.162 | 0.8/3.2 | 3.9 | 7.2 | 0.8/3.2 | 92 | 81 | B | 0.34 | −29.2 | −36.0 | −30.0 | 3.9 | 0.7 | A | B |
| Comp. Ex. 3 | (iii) | P.180/— | 2/0 | 3.9 | 6.7 | 2/0 | 87 | 72 | E | 0.20 | −17.1 | −33.1 | −13.2 | 8.1 | 4.9 | B | C |
| Comp. Ex. 4 | (iv) | —/S.162 | 0/3 | 3.9 | 6.8 | 0/3 | 96 | 77 | A | 0.93 | −15.2 | −8.6 | −6.7 | 20.1 | 7.8 | A | A |

*The fixing roller inspected after the continuous image formation on 3000 sheets in Comparative Example 4 exhibited a trace of dyeing with the colorant.

Example 19

Yellow toner (1) prepared in Toner Production Example 1 was blended with a magnetic carrier (acrylic resin-coated carrier having a volume-average particle size of 40 μm) by a V-shaped blender to provide a two-component developer having a toner concentration of 8 wt. %. The resultant two-component developer was charged in a developing device 4 of an image forming apparatus having a structure as illustrated in FIG. 1 (including a 60 mm-dia. photosensitive drum 1 and a 25 mm-dia. developing sleeve 11 providing an outer diameter ratio of 2.4:1) and subjected continuous image formation on 12000 sheets of plain paper in each environment of N/N (23° C./60% RH), L/L (15°

Figure 2:
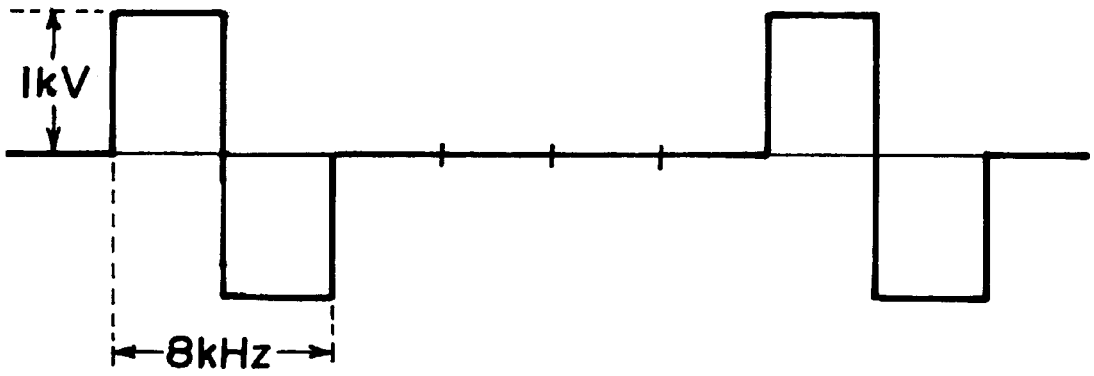
FIG. 2 illustrates an alternating bias electric field for development used in Example 19.

C./15% RH) and H/H (32° C./90% RH). An intermittent alternating bias voltage as shown in FIG. 2 was applied to the developing sleeve 11 during the test.

The representative feature of the toner and the image forming apparatus used in this Example are summarized in Table 3 appearing hereinafter together with those of the following Examples and Comparative. Examples.

The developer was evaluated with respect to the following items and the results thereof are inclusively shown in Table 4 together with those of the following Examples and Comparative Examples.

(1) Image density

The image density of solid image portions of the resultant images on 10th and 12000th sheets were measured as a relative density against that of white image portion by means of a densitometer ("Macbeth Densitometer RD 918", mfd. by Macbeth Co.) equipped with an SPI filter.

(2) Fog

Fog level was measured on 10th and 12000th image sheets formed in the environment of L/L by using a reflection densitometer ("Reflectometer Model TC-6DS", mfd. by Tokyo Denshoku K.K.). More specifically, the maximum reflection density on the white image portion of a relevant image sheet after the image formation was measured at Ds and compared with an average reflection density Dr of white plain paper before the image formation to calculate a fog level as Ds−Dr.

An image at a fog level of below 2% is regarded as a good image substantially free from fog, and an image at a fog level exceeding 5% is regarded as an unclear image with noticeable fog.

(3) Line image scattering

After the continuous image formation on 12000 sheets in the environment of H/H, 200 μm-wide line images were outputted to measure the width of the resultant line images to evaluate a level of thickening of the line images due to scattering. The results are evaluated according to the following standard based on the measured width.

A: ≦210 μm

B: >210 μm and ≦220 μm

C: >220 μm and ≦230 μm

D: >230 μm (4) Toner melt-sticking onto the photosensitive drum

After the continuous image formation on 12000 sheets in the environment of H/H, a solid image was outputted. The evaluation was performed by counting the number of white image dropout defects appearing in a width of image corresponding to one circumferential length of the drum. The evaluation was performed according to the following standard based on the number of measured defects.

A: 0–3 defects

B: 4–10 defects

C: 11–20 defects

D: 21 or more defects

Example 20

Image formation and evaluation were performed in the same manner as in Example 19 except for using a photosensitive drum having a reduced outer diameter of 45 mm.

Example 21

Image formation and evaluation were performed in the same manner as in Example 19 except for using Yellow toner (2) instead of Yellow toner (1).

Example 22

Yellow toner (13) prepared in Example 13 was used as a mono-component developer and incorporated in an image forming apparatus having a structure as illustrated in FIG. 3 (including a 65 mm-dia. photosensitive drum and a 20 mm-dia. developing sleeve providing an outer diameter ratio of 3.3:1) and subjected to image formation on 12000 sheets of plain paper in each environment of N/N (23° C./60% RH), L/L (15° C./15% RH) and H/H (32° C./90% RH).

The evaluation was performed with respect to the same items as in Example 19, and the results are also shown in Table 4.

Example 23

Image formation and evaluation were performed in the same manner as in Example 22 except for using Yellow toner (9) instead of Yellow toner (13).

Example 24

Image formation and evaluation were performed in the same manner as in Example 22 except for using Yellow toner (14) instead of Yellow toner (13) and reducing the outer diameter of the photosensitive drum and the developing sleeve in the image forming apparatus to 30 mm and 16 mm, respectively.

Example 25

Image formation and evaluation were performed in the same manner as in Example 24 except for using Yellow toner (5) instead of Yellow toner (14).

Example 26

Image formation and evaluation were performed in the same manner as in Example 22 except for changing the outer diameter of the photosensitive drum and the developing sleeve in the image forming apparatus to 75 mm and 6 mm, respectively.

Example 27

Yellow toner (1) was used as a mono-component developer and incorporated in an image forming apparatus having a structure as illustrated in FIG. 4 (including a 160 mm-dia. photosensitive drum and a 25 mm-dia. developing sleeve providing an outer diameter ratio of 6.4:1) and subjected to image formation on 12000 sheets of plain paper in each environment of N/N (23° C./60% RH), L/L (15° C./15% RH) and H/H (32° C./90% RH).

The evaluation was performed with respect to the same items as in Example 19, and the results are also shown in Table 4.

Example 28

Image formation and evaluation were performed in the same manner as in Example 27 except for using a developing sleeve having an increased outer diameter of 50 mm.

Example 29

Yellow toner (1) was blended with a magnetic carrier (styrene resin-coated carrier having a volume-average particle size of 45 μm) by a V-shaped blender to provide a two-component developer having a toner concentration of 8 wt. %. The resultant two-component developer was charged in a developing device 4 of an image forming apparatus having a structure as illustrated in FIG. 5 (including a 190 mm-dia. photosensitive drum 1 and a 25 mm-dia. developing sleeve 11 providing an outer diameter ratio of 7.6:1) and subjected to continuous image formation on 12000 sheets of plain paper in each environment of N/N (23° C./60% RH), L/L (15° C./15% RH) and H/H (32° C./90% RH).

The evaluation was performed with respect to the same items as in Example 19, and the results are also shown in Table 4.

Comparative Example 5

Image formation and evaluation were performed in the same manner as in Example 20 except for using Comparative Yellow toner (i) instead of Yellow toner (1).

Comparative Example 6

Image formation and evaluation were performed in the same manner as in Example 22 except for using Comparative Yellow toner (ii) instead of Yellow toner (13).

What is claimed is:

1. A particulate yellow toner, comprising: at least a binder resin and a yellow colorant, wherein the yellow colorant comprises at least a pigment represented by structural formula (1) or structural formula (2) shown below, and a dye represented by structural formula (3) shown below:

[Formula (1)]

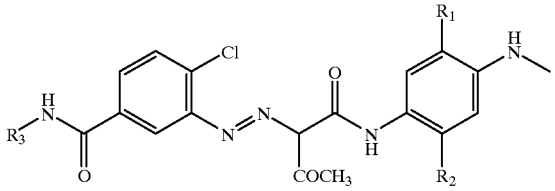

TABLE 3

| Ex. & Comp. Ex. | Yellow toner | Image forming apparatus: Structure | Outer diameter (OD: mm): Photosensitive drum | Outer diameter (OD: mm): Developing sleeve | OD ratio |
|---|---|---|---|---|---|
| Ex. 19 | (1) | FIG. 1 | 60 | 25 | 2.4:1 |
| Ex. 20 | (1) | FIG. 1 | 45 | 25 | 1.8:1 |
| Ex. 21 | (2) | FIG. 1 | 60 | 25 | 2.4:1 |
| Ex. 22 | (13) | FIG. 3 | 65 | 20 | 3.3:1 |
| Ex. 23 | (9) | FIG. 3 | 65 | 20 | 3.3:1 |
| Ex. 24 | (14) | FIG. 3 | 30 | 16 | 1.9:1 |
| Ex. 25 | (5) | FIG. 3 | 30 | 16 | 1.9:1 |
| Ex. 26 | (13) | FIG. 3 | 75 | 6 | 12.5:1 |
| Ex. 27 | (1) | FIG. 4 | 160 | 25 | 6.4:1 |
| Ex. 28 | (1) | FIG. 4 | 160 | 50 | 3.2:1 |
| Ex. 29 | (1) | FIG. 5 | 190 | 25 | 7.6:1 |
| Comp. Ex. 5 | Comparative (i) | FIG. 1 | 45 | 25 | 1.8:1 |
| Comp. Ex. 6 | Comparative (ii) | FIG. 3 | 65 | 20 | 3.3:1 |

TABLE 4

| Ex. or Comp. Ex. | Image density on 10th sheet: N/N | L/L | H/H | Image density on 12000th sheet: N/N | L/L | H/H | Fog (%): 10th sheet L/L | Fog (%): 12000th sheet L/L | Line image scattering H/H | Toner sticking H/H |
|---|---|---|---|---|---|---|---|---|---|---|
| Ex. 19 | 1.55 | 1.57 | 1.51 | 1.54 | 1.55 | 1.47 | 0.5 | 0.8 | B | A |
| Ex. 20 | 1.54 | 1.56 | 1.53 | 1.53 | 1.54 | 1.52 | 0.3 | 0.8 | A | A |
| Ex. 21 | 1.54 | 1.56 | 1.51 | 1.53 | 1.54 | 1.45 | 0.5 | 0.8 | B | A |
| Ex. 22 | 1.54 | 1.57 | 1.53 | 1.53 | 1.51 | 1.52 | 0.7 | 1.5 | A | B |
| Ex. 23 | 1.54 | 1.55 | 1.53 | 1.53 | 1.48 | 1.52 | 0.9 | 1.6 | A | B |
| Ex. 24 | 1.54 | 1.56 | 1.50 | 1.53 | 1.54 | 1.46 | 0.5 | 0.8 | B | A |
| Ex. 25 | 1.54 | 1.56 | 1.53 | 1.53 | 1.52 | 1.52 | 0.5 | 1.1 | A | B |
| Ex. 26 | 1.46 | 1.47 | 1.41 | 1.41 | 1.44 | 1.35 | 1.5 | 3.0 | B | B |
| Ex. 27 | 1.54 | 1.56 | 1.52 | 1.48 | 1.47 | 1.44 | 0.5 | 0.8 | B | A |
| Ex. 28 | 1.48 | 1.49 | 1.44 | 1.47 | 1.47 | 1.39 | 0.8 | 1.5 | B | B |
| Ex. 29 | 1.54 | 1.56 | 1.54 | 1.47 | 1.46 | 1.43 | 0.5 | 0.9 | B | A |
| Comp. Ex. 5 | 1.42 | 1.42 | 1.39 | 1.44 | 1.39 | 1.43 | 1.2 | 3.6 | C | D |
| Comp. Ex. 6 | 1.33 | 1.34 | 1.30 | 1.09 | 1.11 | 1.09 | 1.2 | 2.3 | D | C |

-continued

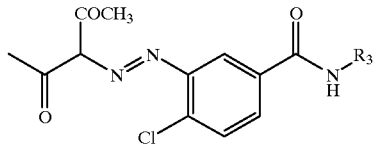

wherein $R_1$ and $R_2$ independently denote a hydrogen atom, a chlorine atom or —$CH_3$, and $R_3$ denotes

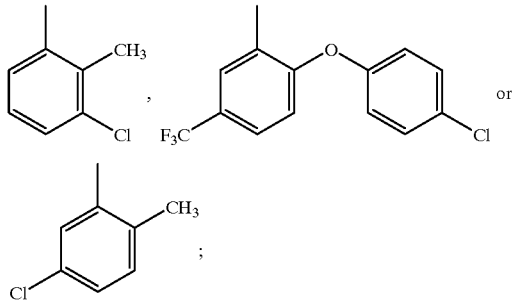

[Formula (2)]

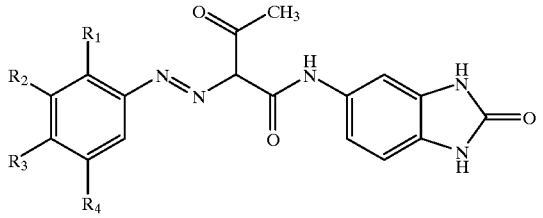

wherein $R_1$, $R_2$, $R_3$ and $R_4$ independently denote a hydrogen atom, —COOH, —$COOCH_3$, —$CF_3$, —$CONH(C_6H_4)CONH_2$, or

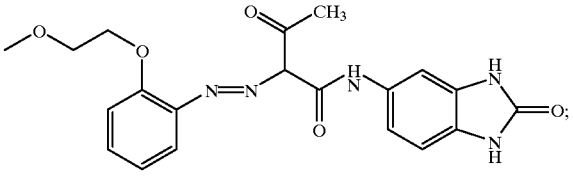

[Formula (3)]

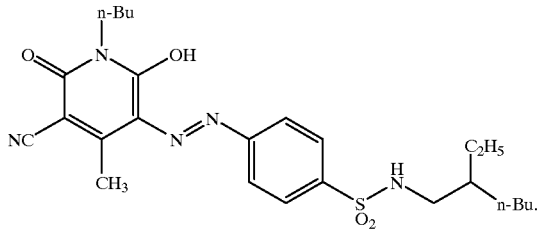

2. The yellow toner according to claim 1, wherein the pigment represented by the formula (1) or (2) is contained in 0.5–7.5 wt. parts per 100 wt. parts of the binder resin.

3. The yellow toner according to claim 1, wherein the pigment represented by the formula (1) or (2) is contained in 1.0–6.0 wt. parts per 100 wt. parts of the binder resin.

4. The yellow toner according to claim 1, wherein the pigment represented by the formula (1) or (2) is contained in 2.0–4.0 wt. parts per 100 wt. parts of the binder resin.

5. The yellow toner according to claim 1, wherein the dye represented by the formula (3) is contained in 0.2–5.0 wt. parts per 100 wt. parts of the binder resin.

6. The yellow toner according to claim 1, wherein the dye represented by the formula (3) is contained in 0.5–4.0 wt. parts per 100 wt. parts of the binder resin.

7. The yellow toner according to claim 1, wherein the pigment and the dye are contained in a weight ratio of 0.2–5.

8. The yellow toner according to claim 1, wherein the pigment and the dye are contained in a weight ratio of 0.33–3.

9. The yellow toner according to claim 1, wherein the pigment represented by the formula (1) is a pigment selected from the group consisting of C.I. Pigment Yellow 93, 94, 95, 128 and 166.

10. The yellow toner according to claim 1, wherein the pigment represented by the formula (1) is C.I. Pigment Yellow 93.

11. The yellow toner according to claim 1, wherein the pigment represented by the formula (2) is a pigment selected from the group consisting of C.I. Pigment Yellow 120, 151, 154, 175, 180 and 181.

12. The yellow toner according to claim 1, wherein the pigment represented by the formula (2) is C.I. Pigment Yellow 180.

13. The yellow toner according to claim 1, wherein the yellow toner further contains an organo-metal compound.

14. The yellow toner according to claim 13, wherein the organo-metal compound is a metal compound including a ligand selected from the group consisting of salicylic acid, naphthoic acid, benzilic acid and dicarboxylic acids.

15. The yellow toner according to claim 13, wherein the organo-metal compound is salicylic acid aluminum compound.

16. The yellow toner according to claim 1, wherein the yellow toner further contains an ester wax.

17. The yellow toner according to claim 16, wherein the ester wax has a long-chain alkyl group of at least 15 carbon atoms.

18. The yellow toner according to claim 16, wherein the ester wax is contained in 2–30 wt. % of the yellow toner.

19. The yellow toner according to claim 1, wherein the yellow toner has a weight-average particle size of 3–9 $\mu$m.

20. The yellow toner according to claim 1, wherein the yellow toner has an acid value of 0.02–15 mgKOH/g.

21. The yellow toner according to claim 1, wherein the yellow toner has an acid value of 0.05–12 mgKOH/g.

22. The yellow toner according to claim 1, wherein the binder resin principally comprises a styrene-acrylic resin.

23. A process for producing a yellow toner, comprising the steps of:

dispersing a monomer composition comprising at least a polymerizable monomer, a pigment represented by structural formula (1) or structural formula (2) shown below, and a dye represented by structural formula (3) shown below in an aqueous dispersion medium to form particles of the composition, and polymerizing the polymerizable monomer in the dispersed particles to obtain toner particles:

[Formula (1)]

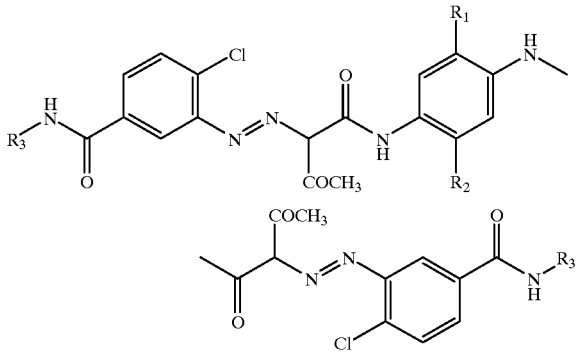

wherein $R_1$ and $R_2$ independently denote a hydrogen atom, a chlorine atom or —$CH_3$, and $R_3$ denotes

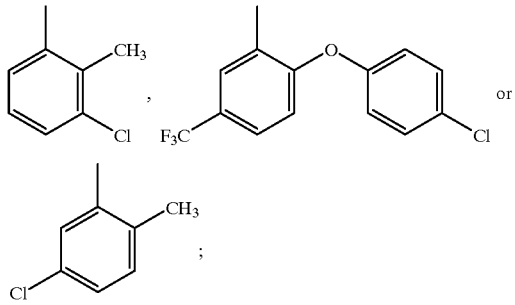

[Formula (2)]

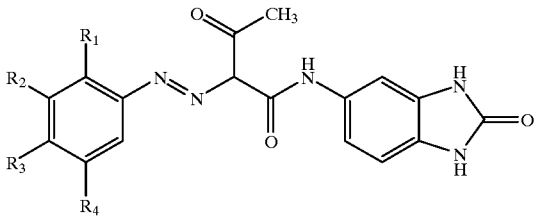

wherein $R_1$, $R_2$, $R_3$ and $R_4$ independently denote a hydrogen atom, —COOH, —$COOCH_3$, —$CF_3$, —$CONH(C_6H_4)CONH_2$,

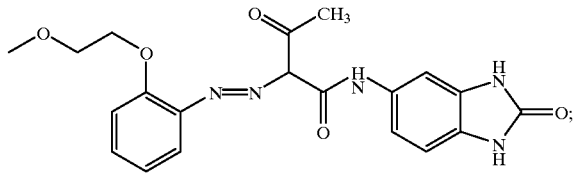

[Formula (3)]

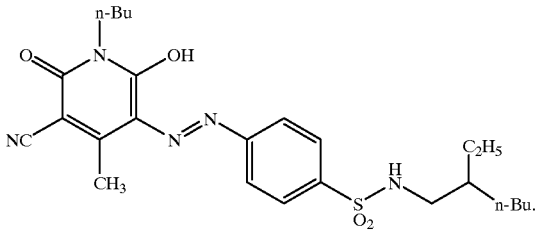

24. The process according to claim 23, wherein the pigment represented by the formula (1) or (2) is added in 0.5–7.5 wt. parts per 100 wt. parts of the polymerizable monomer.

25. The process according to claim 23, wherein the pigment represented by the formula (1) or (2) is added in 1.0–6.0 wt. parts per 100 wt. parts of the polymerizable monomer.

26. The process according to claim 23, wherein the pigment represented by the formula (1) or (2) is added in 2.0–4.0 wt. parts per 100 wt. parts of the polymerizable monomer.

27. The process according to claim 23, wherein the dye represented by the formula (3) is added in 0.2–5.0 wt. parts per 100 wt. parts of the polymerizable monomer.

28. The process according to claim 23, wherein the dye represented by the formula (3) is added in 0.5–4.0 wt. parts per 100 wt. parts of the polymerizable monomer.

29. The process according to claim 24, wherein the pigment and the dye are added in a weight ratio of 0.2–5.

30. The process according to claim 24, wherein the pigment and the dye are added in a weight ratio of 0.33–3.

31. The process according to claim 24, wherein the pigment represented by the formula (1) is a pigment selected from the group consisting of C.I. Pigment Yellow 93, 94, 95, 128 and 166.

32. The process according to claim 24, wherein the pigment represented by the formula (1) is C.I. Pigment Yellow 93.

33. The process according to claim 24, wherein the pigment represented by the formula (2) is a pigment selected from the group consisting of C.I. Pigment Yellow 120, 151, 154, 175, 180 and 181.

34. The process according to claim 24, wherein the pigment represented by the formula (2) is C.I. Pigment Yellow 180.

35. The process according to claim 24, wherein the monomer composition further contains an organo-metal compound.

36. The process according to claim 35, wherein the organo-metal compound is a metal compound including a ligand selected from the group consisting of salicylic acid, naphthoic acid, benzilic acid and dicarboxylic acids.

37. The process according to claim 35, wherein the organo-metal compound is salicylic acid aluminum compound.

38. The process according to claim 24, wherein the monomer composition further contains an ester wax.

39. The process according to claim 38, wherein the ester wax has a long-chain alkyl group of at least 15 carbon atoms.

40. The process according to claim 38, wherein the ester wax is contained in 2–30 wt. % of the yellow toner.

41. The process according to claim 24, wherein the resultant yellow toner has a weight-average particle size of 3–9 $\mu$m.

42. The process according to claim 24, wherein the resultant yellow toner has an acid value of 0.02–15 mgKOH/g.

43. The process according to claim 24, wherein the resultant yellow toner has an acid value of 0.05–12 mgKOH/g.

44. The process according to claim 24, wherein the polymerizable monomer is selected from the group consisting of styrene monomers, acrylate monomers and methacrylate monomers.

45. An image forming method, comprising: forming an electrostatic image on an image-bearing member, and developing the electrostatic image with a particulate developer carried on a developer-carrying member, wherein the particulate developer comprises a particulate yellow toner comprising: at least a binder resin and a yellow colorant, and the yellow colorant comprises at least a pigment represented by structural formula (1) or structural formula (2) shown below, and a dye represented by structural formula (3) shown below:

[Formula (1)]

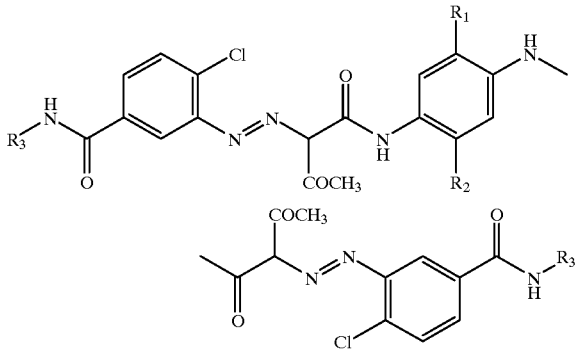

wherein $R_1$ and $R_2$ independently denote a hydrogen atom, a chlorine atom or —$CH_3$, and $R_3$ denotes

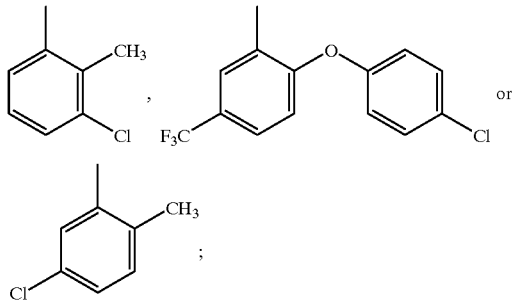

[Formula (2)]

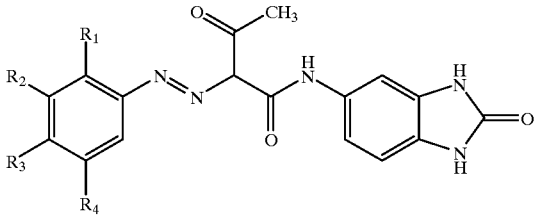

wherein $R_1$, $R_2$, $R_3$ and $R_4$ independently denote a hydrogen atom, —COOH, —$COOCH_3$, —$CF_3$, —$CONH(C_6H_4)CONH_2$, or

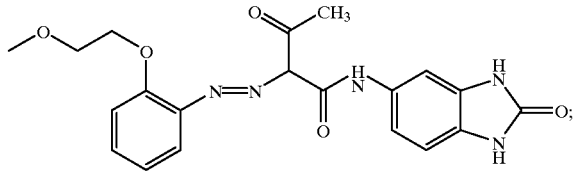

-continued

[Formula (3)]

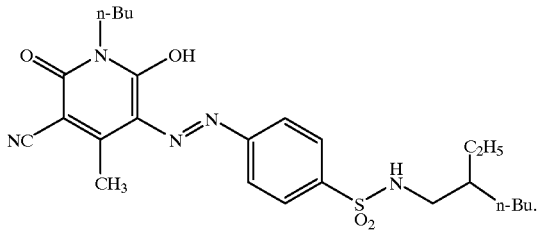

46. The image forming method according to claim 45, wherein the developer carrying member has an outer diameter of 10–30 mm.

47. The image forming method according to claim 45, wherein the image-bearing member and the developer-carrying member have outer diameters in a ratio of 10:1 to 1:1.

48. The image forming method according to claim 45, wherein the image-bearing member and the developer-carrying member have outer diameters in a ratio of 5:1 to 1:1.

49. The image forming method according to claim 45, wherein the image-bearing member and the developer-carrying member have outer diameters in a ratio of 3:1 to 1:1.

50. The image forming method according to claim 45, wherein the image-bearing member and the developer-carrying member have outer diameters in a ratio of 2:1 to 1:1.

51. The image forming method according to claim 45, wherein the pigment represented by the formula (1) or (2) is contained in the yellow toner in 0.5–7.5 wt. parts per 100 wt. parts of the binder resin.

52. The image forming method according to claim 45, wherein the pigment represented by the formula (1) or (2) is contained in the yellow toner in 1.0–6.0 wt. parts per 100 wt. parts of the binder resin.

53. The image forming method according to claim 45, wherein the pigment represented by the formula (1) or (2) is contained in the yellow toner in 2.0–4.0 wt. parts per 100 wt. parts of the binder resin.

54. The image forming method according to claim 45, wherein the dye represented by the formula (3) is contained in the yellow toner in 0.2–5.0 wt. parts per 100 wt. parts of the binder resin.

55. The image forming method according to claim 45, wherein the dye represented by the formula (3) is contained in the yellow toner in 0.5–4.0 wt. parts per 100 wt. parts of the binder resin.

56. The image forming method according to claim 45, wherein the pigment and the dye are contained in the yellow toner in a weight ratio of 0.2–5.

57. The image forming method according to claim 45, wherein the pigment and the dye are contained in the yellow toner in a weight ratio of 0.33–3.

58. The image forming method according to claim 45, wherein the pigment represented by the formula (1) is a pigment selected from the group consisting of C.I. Pigment Yellow 93, 94, 95, 128 and 166.

59. The image forming method according to claim 45, wherein the pigment represented by the formula (1) is C.I. Pigment Yellow 93.

60. The image forming method according to claim 45, wherein the pigment represented by the formula (2) is a pigment selected from the group consisting of C.I. Pigment Yellow 120, 151, 154, 175, 180 and 181.

61. The image forming method according to claim 45, wherein the pigment represented by the formula (2) is C.I. Pigment Yellow 180.

62. The image forming method according to claim 45, wherein the yellow toner further contains an organo-metal compound.

63. The image forming method according to claim 62, wherein the organo-metal compound is a metal compound including a ligand selected from the group consisting of salicylic acid, naphthoic acid, benzilic acid and dicarboxylic acids.

64. The image forming method according to claim 62, wherein the organo-metal compound is salicylic acid aluminum compound.

65. The image forming method according to claim 45, wherein the yellow toner further contains an ester wax.

66. The image forming method according to claim 65, wherein the ester wax has a long-chain alkyl group of at least 15 carbon atoms.

67. The image forming method according to claim 65, wherein the ester wax is contained in 2–30 wt. % of the yellow toner.

68. The image forming method according to claim 45, wherein the yellow toner has a weight-average particle size of 3–9 $\mu$m.

69. The image forming method according to claim 45, wherein the yellow toner has an acid value of 0.02–15 mgKOH/g.

70. The image forming method according to claim 45, wherein the yellow toner has an acid value of 0.05–12 mgKOH/g.

71. The image forming method according to claim 45, wherein the binder resin in the yellow toner principally comprises a styrene-acrylic resin.

* * * * *